US009089743B2

(12) United States Patent
Severa et al.

(10) Patent No.: US 9,089,743 B2
(45) Date of Patent: Jul. 28, 2015

(54) RACQUET CONFIGURED WITH FEWER CROSS STRINGS THAN MAIN STRINGS

(71) Applicant: Wilson Sporting Goods Co., Chicago, IL (US)

(72) Inventors: William D. Severa, Darien, IL (US); John B. Lyons, Wilmette, IL (US); Robert T. Kapheim, Elmhurst, IL (US); Robert T. Thurman, Plainfield, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 13/894,588

(22) Filed: May 15, 2013

(65) Prior Publication Data

US 2014/0206482 A1 Jul. 24, 2014

Related U.S. Application Data

(60) Provisional application No. 61/675,029, filed on Jul. 24, 2012.

(51) Int. Cl.

| | |
|---|---|
| ***A63B 49/02*** | (2006.01) |
| ***A63B 49/10*** | (2015.01) |
| ***A63B 51/00*** | (2015.01) |
| ***A63B 59/00*** | (2015.01) |
| ***A63B 51/02*** | (2015.01) |

(52) U.S. Cl.

CPC ..... *A63B 49/10* (2013.01); *A63B 51/00* (2013.01); *A63B 51/02* (2013.01); *A63B 59/0074* (2013.01); *A63B 2049/0229* (2013.01); *A63B 2049/0235* (2013.01); *A63B 2049/0241* (2013.01)

(58) Field of Classification Search

CPC ..... A63B 49/00; A63B 49/02; A63B 2049/0223; A63B 2049/0229; A63B 2049/0235; A63B 2049/0241; A63B 51/00; A63B 51/02; A63B 49/10; A63B 59/0074

USPC ..... 473/524, 537, 543

See application file for complete search history.

(56) References Cited

U.S. PATENT DOCUMENTS

| | | | |
|---|---|---|---|
| 323,608 | A | 8/1885 | Turner |
| 455,632 | A | 7/1891 | Malings |
| 644,877 | A | 3/1900 | Slazenger |
| 801,246 | A | 10/1905 | Johnson |

(Continued)

FOREIGN PATENT DOCUMENTS

| | | | | |
|---|---|---|---|---|
| DE | 27 30 739 | | 1/1979 | |
| GB | 2179863 | A * | 3/1987 | ..... A63B 51/00 |

*Primary Examiner* — Raleigh W Chiu

(74) *Attorney, Agent, or Firm* — Terence P. O'Brien

(57) ABSTRACT

A racquet including a frame having a head portion coupled to a handle portion, and a string bed of interlaced cross and main string segments. The head portion includes a hoop having inner and outer peripheral walls. The hoop defines a head size having a maximum longitudinal and transverse dimensions, a, and b, respectively. The dimension a is at least 1.2 times the dimension b. The inner peripheral wall includes string holes. The cross segments transversely extend from one of the string holes to another, and the main segments longitudinally extend from one of the string holes to another. The cross segment closest to the handle portion and the end point of the longitudinal dimension, a, closest to the handle portion define a second longitudinal dimension, c. The ratio of dimension a to dimension c is at least 6.5. The string bed has at least one more main segment than cross segment.

22 Claims, 16 Drawing Sheets

(56) References Cited

U.S. PATENT DOCUMENTS

| | | | | | |
|---|---|---|---|---|---|
| 971,773 | A | | 10/1910 | Mueller | |
| 1,132,214 | A | | 3/1915 | Brown | |
| 1,173,712 | A | | 2/1916 | Bois | |
| 1,292,317 | A | | 1/1919 | Holding | |
| 1,531,778 | A | | 3/1925 | Gallaudet | |
| 1,531,862 | A | | 3/1925 | Larned | |
| 1,532,703 | A | | 4/1925 | Larned | |
| 1,609,662 | A | | 12/1926 | Rawlings et al. | |
| 1,624,720 | A | | 4/1927 | Dritz | |
| 1,695,595 | A | | 12/1928 | Larned | |
| 1,733,960 | A | | 10/1929 | Godfrey | |
| 2,059,917 | A | | 11/1936 | Spencer | 273/73 |
| 2,401,291 | A | | 5/1946 | Smith | 57/140 |
| 2,542,661 | A | | 2/1951 | Godfrey | 273/73 |
| 2,626,804 | A | | 1/1953 | Robinson | 273/73 |
| 2,878,020 | A | | 3/1959 | Robinson | 273/73 |
| 3,239,224 | A | | 3/1966 | Finn et al. | 273/73 |
| 3,545,756 | A | | 12/1970 | Nash | 273/73 |
| 3,738,096 | A | | 6/1973 | Crandall | 57/149 |
| 3,801,099 | A | * | 4/1974 | Lair | 473/537 |
| 3,820,785 | A | | 6/1974 | Occhipinti et al. | 273/29 |
| 3,834,699 | A | | 9/1974 | Pass | 273/73 |
| 3,999,756 | A | | 12/1976 | Head | 273/73 |
| 4,013,289 | A | | 3/1977 | Kaminstein | 273/73 |
| 4,016,714 | A | | 4/1977 | Crandall et al. | 57/149 |
| 4,026,553 | A | | 5/1977 | Vendramini | 273/73 |
| 4,033,582 | A | | 7/1977 | Linden | 273/73 |
| 4,093,220 | A | | 6/1978 | Prewarski | 273/73 |
| 4,172,596 | A | | 10/1979 | Linden | 273/73 |
| 4,190,249 | A | | 2/1980 | Fischer | 273/73 |
| 4,231,575 | A | | 11/1980 | Kutt et al. | 273/73 |
| 4,299,385 | A | | 11/1981 | Boden | 273/73 |
| 4,377,620 | A | * | 3/1983 | Alexander | 428/372 |
| 4,754,968 | A | | 7/1988 | Fischer | 273/73 |
| 5,219,165 | A | | 6/1993 | Janes et al. | 273/73 |
| 5,277,422 | A | | 1/1994 | Coe | 273/73 |
| 5,310,179 | A | * | 5/1994 | Takatsuka | 473/537 |
| 6,027,420 | A | | 2/2000 | Soong | 473/540 |
| 6,344,006 | B1 | * | 2/2002 | Brandt | 473/543 |
| 6,432,005 | B1 | | 8/2002 | Lin | 473/540 |
| 6,764,417 | B1 | | 7/2004 | Filippini | 473/548 |
| 6,811,502 | B1 | | 11/2004 | Janes et al. | 473/546 |
| 6,935,974 | B2 | | 8/2005 | Filippini | 473/543 |
| 7,081,056 | B2 | * | 7/2006 | Brandt | 473/543 |
| 7,247,373 | B2 | * | 7/2007 | Akagi et al. | 428/372 |
| 7,691,016 | B2 | * | 4/2010 | Ashino | 473/539 |
| 7,806,789 | B2 | * | 10/2010 | Sledge | 473/524 |
| 2001/0041632 | A1 | * | 11/2001 | Bertolotti | 473/543 |
| 2002/0039938 | A1 | * | 4/2002 | Yeh | 473/524 |

* cited by examiner

RACQUET CONFIGURED WITH FEWER CROSS STRINGS THAN MAIN STRINGS

RELATED APPLICATIONS

The present application claims priority to U.S. Provisional Patent Application Ser. No. 61/675,029 titled RACQUET CONFIGURED WITH FEWER CROSS STRINGS THAN MAIN STRINGS, and filed on Jul. 24, 2012. The present application is related to co-pending U.S. patent application Ser. No. 13/894,611, filed on the same day herewith by William D. Severa, John B. Lyons, Robert T. Kapheim and Robert T. Thurman and each entitled RACQUET CONFIGURED WITH FEWER CROSS STRINGS THAN MAIN STRINGS, the full disclosure of which are hereby incorporated by reference.

FIELD OF THE INVENTION

The present invention relates generally to a sports racquet. In particular, the present invention relates to racquet configured for use with a string bed having fewer cross string segments than main string segments.

BACKGROUND OF THE INVENTION

Sport racquets, such as tennis racquets, are well known and typically include a frame having a head portion coupled to a handle portion. The head portion supports a string bed having a plurality of main string segments alternately interwoven with a plurality of cross string segments. Many racquets also include a throat portion positioned between and connecting the handle portion to the head portion. The typical string bed of a sports racquet includes a central region, that provides the most responsiveness, the greatest power and the best "feel" to the player, upon impact with a ball, and a peripheral region. The central region, commonly referred to as the "sweet spot," is typically defined as the area of the string bed that produces higher coefficient of restitution ("COR") values. A higher COR generally directly corresponds to greater power and greater responsiveness.

The string bed and the configuration of the racquet can also play a role in the amount of spin that a player can impart to a ball during play. The ability to impart a spin (a top spin or a back spin) to a ball increases a player's ability to control the ball during play. For example, imparting a top spin onto a tennis ball can enable a player to swing faster, hit the tennis ball harder and still keep the tennis ball in play within the court. Imparting a top spin to a ball can enable a player to aim higher, swing faster, clear the net and keep the ball in play. Accordingly, characteristics such as spin rate and spin ratio (the ratio of the spin rate of a ball after impact to the spin rate of the ball before impact with the string bed) can be important factors in evaluating a racquet and/or a player's performance. Other characteristics can also be useful in determining the amount of spin a strung racquet can produce to a ball, such as main string deflection, main string snapback time and main string snapback velocity.

Prior art racquets have incorporated different design features in an effort to increase a racquet's ability to impart spin to a ball and/or increase a racquet's sweet spot. Some of the design features include increasing a racquet's head size, increasing the tension of the racquet strings, changing the material of the racquet and/or the racquet strings, and increasing the length of the main and/or cross strings of a racquet. However, such design changes can include drawbacks such as reduced reliability, premature string breakage, premature racquet failure, increased moment of inertia of a racquet and reduced maneuverability.

Thus, there is a continuing need for a racquet configured to enable more spin to be imparted onto a ball during play. There is also a continuing need for a racquet with an enlarged sweet spot that provides an increased "dwell time," without negatively effecting the overall performance of the racquet. It would be advantageous to provide a racquet with an enlarged sweet spot, increased main string deflection, reduced main string snap time, increased main string snap back velocity, and an increased "dwell time" without increasing the polar moment of inertia of the racquet head and without negatively affecting the maneuverability of the racquet. There is also a need for a racquet configured to impart more spin to a ball that is not a radical departure in look and design from traditional sport racquet designs.

SUMMARY OF THE INVENTION

The present invention provides a tennis racquet configured for use with a string bed formed of a plurality of cross string segments interlaced with a plurality of main string segments. The racquet includes a frame extending along a longitudinal axis and including a head portion coupled to a handle portion. The head portion includes a hoop having inner and outer peripheral walls. The hoop defines a head size of the racquet. The head size is within the range of 93 square inches to 120 square inches, having a maximum longitudinal dimension, a, and having a maximum transverse dimension, b. The longitudinal dimension a is at least 1.2 times the transverse dimension b. The inner peripheral wall includes a plurality of cross-string holes and a plurality of main string holes. Each of the cross string holes is configured for receiving one end of one of the cross string segments, and each of the main string holes is configured for receiving one end of one of the main string segments. The number of main string holes is greater than the number of cross string holes such that the string bed configured for use with the racquet has a greater number of main string segments than cross string segments.

According to a principal aspect of a preferred form of the invention, a tennis racquet includes a frame extending along a longitudinal axis and including a head portion coupled to a handle portion, and a string bed coupled to the head portion of the racquet. The head portion includes a hoop having inner and outer peripheral walls. The hoop defines a head size having a maximum longitudinal dimension, a, and has a maximum transverse dimension, b. The longitudinal dimension a is at least 1.2 times the transverse dimension b. The inner peripheral wall includes a plurality of string holes. The string bed includes a plurality of cross string segments interlaced with a plurality of main string segments. Each of the cross string segments transversely extends from one of the string holes to another one of the string holes, and each of the main string segments substantially longitudinally extends from one of the string holes to another one of the string holes. The cross string segment closest to the handle portion and the end point of the maximum longitudinal dimension, a, closest to the handle portion define a second longitudinal dimension, c. The ratio of the maximum longitudinal dimension a to the second longitudinal dimension c is at least 6.5. The string bed has at least one more main string segment than cross string segment.

According to another principal aspect of a preferred form of the invention, a tennis racquet is capable of being tested under a tennis ball spin test. In the spin test, the racquet is securely mounted to a test fixture by four spaced apart mounts such that a plane defined by a string bed is positioned 30 degrees from horizontal. A tennis ball is projected from a ball projecting machine to the string bed at a speed within the range of 38 to 42 miles per hour from an angle that is 50 degrees from an axis normal to the plane of the string bed. The ball and the string bed are monitored under a high speed video system at 5000 frames per second. The racquet includes a frame and a quantity of polyester, monofilament racquet string. The frame extends along a longitudinal axis and includes a head portion coupled to a handle portion. The head portion includes a hoop having inner and outer peripheral walls. The hoop defines a head size having a maximum longitudinal dimension, a, and a maximum transverse dimension, b. The longitudinal dimension a is at least 1.2 times the transverse dimension b. The inner peripheral wall includes a plurality of string holes. The racquet string has a diameter within the range of 1.10 to 1.55 millimeters. The racquet string is coupled to the head portion to form the string bed. The string bed includes a plurality of cross string segments interlaced with a plurality of main string segments. Each of the cross string segments transversely extends from one of the string holes to another one of the string holes, and each of the main string segments substantially longitudinally extends from one of the string holes to another one of the string holes. The string bed has at least one more main string segment than cross string segment. When the racquet is tested under the tennis ball spin test, at least one of the main string segments contacting the tennis ball exhibits a snap back velocity of at least 1 meter per second.

According to another principal aspect of a preferred form of the invention, a tennis racquet is capable of being tested under a tennis string displacement test. In the displacement test, the racquet is securely mounted to a test fixture by four spaced apart mounts such that a plane defined by a string bed is positioned 90 degrees from horizontal (vertically). A tennis ball is projected from a ball projecting machine to the string bed at a speed 60 feet per second from an angle that is 45 degrees from an axis normal to the plane of the string bed. The ball and the string bed are monitored under a high speed video system at 5000 frames per second. The racquet includes a frame and a quantity of polyester, monofilament racquet string. The frame extends along a longitudinal axis and includes a head portion coupled to a handle portion. The head portion includes a hoop having inner and outer peripheral walls. The hoop defines a head size having a maximum longitudinal dimension, a, and a maximum transverse dimension, b. The longitudinal dimension a is at least 1.2 times the transverse dimension b. The inner peripheral wall includes a plurality of string holes. The racquet string has a diameter within the range of 1.10 to 1.55 millimeters. The racquet string is coupled to the head portion to form the string bed. The string bed includes a plurality of cross string segments interlaced with a plurality of main string segments. Each of the cross string segments transversely extends from one of the string holes to another one of the string holes, and each of the main string segments substantially longitudinally extends from one of the string holes to another one of the string holes, such that each of the string holes includes at least one of the cross string segment and the main string segment. The string bed has at least one more main string segment than cross string segment. When the racquet is tested under the tennis ball displacement test, at least one of the main string segments contacting the tennis ball exhibits a string deflection of at least 5 mm.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
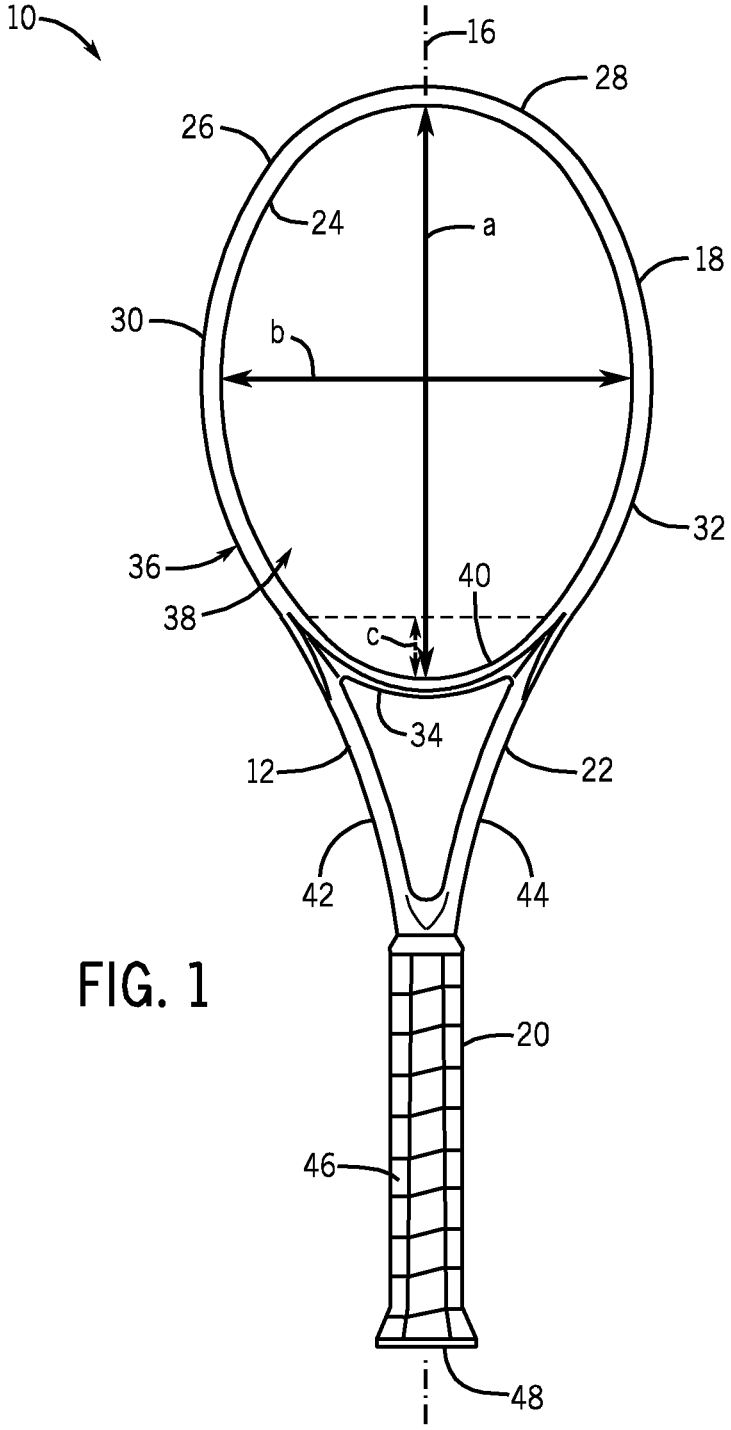
FIG. 1 is a front side perspective view of a racquet in accordance with a preferred embodiment of the present invention.

Referring to FIG. 1, a sports racquet is indicated generally at 10. The racquet 10 of FIG. 1 is configured as a tennis racquet. The racquet 10 includes a frame 12 extending along a longitudinal axis 16 and including a head portion 18, a handle portion 20, and a throat portion 22 coupling the head and handle portions 18 and 20. The frame 12 is a tubular structure formed of a lightweight, durable material, preferably a carbon-fiber composite material.

As used herein, the term "fiber composite material" or "composite material" refers to a plurality of fibers impregnated (or permeated throughout) with a resin. The fibers can be co-axially aligned in sheets, layers or plies, or braided or weaved in sheets or layers, and/or chopped and randomly dispersed in one or more layers. A single ply typically includes hundreds or thousands of fiber bundles that are initially arranged to extend coaxially and parallel with each other through the resin that is initially uncured. Each of the fiber bundles includes a plurality of fibers. The fibers are formed of a high tensile strength material such as carbon. Alternatively, the fibers can be formed of other materials such as, for example, glass, graphite, boron, basalt, carrot, Kevlar®, Spectra®, poly-para-phenylene-2,6-benzobisoxazole (PBO), hemp and combinations thereof. In one set of preferred embodiments, the resin is preferably a thermosetting resin such as epoxy or polyester resins. In other sets of preferred embodiments, the resin can be a thermoplastic resin. The composite material is typically wrapped about a mandrel and/or a comparable structure, and cured under heat and/or pressure. While curing, the resin is configured to flow and fully disperse and impregnate the matrix of fibers. In multiple layer or ply constructions, the fibers can be aligned in different directions with respect to the longitudinal axis 16, and/or in braids or weaves from layer to layer. Alternatively, the frame 12 can be formed of other materials including metallic alloys, other composite materials, wood, or combinations thereof.

The head portion 18 is a tubular structure that includes inner and outer peripheral walls 24 and 26. The head portion 18 can be broken down into regions, such as, a distal region 28, first and second side regions 30 and 32, and a proximal region 34, which collectively define a hoop 36 having a string bed area 38 for receiving and supporting the string bed 14 (see FIG. 4). In one preferred embodiment, the proximal region 34 includes a yoke 40. The string bed area 38 is also referred to as the head size of the racquet 10. In a preferred embodiment, the head size or string bed area 38 of the racquet 10 is within the range of 93 to 120 square inches. In a more preferred embodiment, the head size of the racquet 10 is within the range 98 to 115 square inches. In alternative preferred embodiments, other head sizes can also be used and are contemplated under the present invention. The string bed area 38 has a maximum longitudinal dimension, a, and a maximum transverse dimension, b. The hoop 36 can be any closed curved shape including, for example, a generally oval shape, a generally tear-drop shape, a generally pear shape, and combinations thereof. The shape of the hoop 36 is preferably non-circular. The maximum longitudinal dimension is preferably at least 1.2 times the maximum transverse dimension ($a \geq 1.2*b$). In a particularly preferred embodiment, the maximum longitudinal dimension is preferably at least 1.25 times the maximum transverse dimension ($a \geq 1.25*b$).

The yoke 40 is an elongate tubular structural member which extends from the first side region 30 to the second side region 32 of the head portion 18. In one preferred embodiment, the yoke 40 is integrally formed with the frame 12 defining the proximal region 34. In alternative preferred embodiments, the yoke 40 can be connected through use of adhesives, fasteners, bonding and combinations thereof. The yoke 40 is formed of a lightweight, durable material, preferably a carbon-fiber composite material. Alternatively, the yoke 40 can be formed of other materials, such as, for example, metallic alloys, other composite materials including basalt fibers, and combinations thereof.

In a preferred embodiment, the first and second side regions 30 and 32 downwardly extend from the head portion 18 to form first and second throat tubes 42 and 44 of the throat portion 22. The first and second throat tubes 42 and 44 converge and further downwardly extend to form the handle portion 20. The handle portion 20 includes a pallet (not shown), a grip 46 and a butt cap 48. In alternative preferred embodiments, the handle portion 20 can be a tubular structure that does not include an extension of the first and second throat tubes. In this alternative preferred embodiment, the handle portion can be a tubular structure separate from either the throat portion or the head portion of the frame and attached to the throat portion through use of conventional fasteners, molding techniques, bonding techniques, adhesives or combinations thereof.

In another preferred embodiment, the head portion 18 is directly connected to one or both of the throat portion 22 and the yoke 40 through the use of conventional fasteners, adhesives, mechanical bonding, thermal bonding, or other combinations thereof. Alternatively, the head portion 18 can be separated from one or both of the throat portion and the yoke by a vibration and shock absorbing material, such as an elastomer. In yet another alternative preferred embodiment, the head portion 18 is integrally formed with one or both of the throat portion 22 and the yoke 40.

Referring to FIGS. 2 through 6, the racquet 10 configured for supporting a string bed 14 is formed by a plurality of main string segments 50 alternately interwoven or interlaced with a plurality of cross string segments 52. The string bed 14 is preferably generally uniform with constant spacing between the string segments 50 and 52. Alternatively, the string bed 14 can have some spacing variability provided that the spacing of the main and cross string segments of the string bed is most dense at the center of the string bed 14 (or near the geometric center of the string bed or string bed area). The main and cross string segments 50 and 52 can be formed from one continuous piece of racquet string, or from two or more pieces of racquet string. The racquet string is formed of a high tensile strength, flexible material. In preferred embodiments, the racquet string can be formed of a polyester material, a nylon, a natural gut material and/or a synthetic gut material. The polyester materials used to make the racquet string can include polyether ether ketone (PEEK), polytetrafluoroethylene (PTFE), other polyester materials, and combinations thereof. The racquet string can be formed in a monofilament construction or in a multiple-filament construction. The racquet string can be formed of various different diameters (or gauges). Preferably, the diameter of the racquet string is within the range 1.10 to 1.55 mm.

The main and cross string segments 50 and 52 refer to the portions of the racquet string that make up the string bed 14. The string bed 14 generally defines a string bed plane 54. Each of the main and cross string segments 50 and 52 can be considered to have first and second ends or end regions. The racquet string can, but typically does not, terminate, end or cutoff in or at the ends or end regions. Rather, the ends or end regions of the main and cross string segments 50 and 52 are defined as the location where the main and cross string segments 50 and 52 extend through the string holes in the hoop 36. Other than to accommodate the interlacing or interweaving of the main and cross string segments 50 and 52, the main and cross string segments 50 and 52 preferably extend substantially along the string bed plane 54 as they extend across the string bed area 38. Maintaining the main and cross string segments 50 and 52 substantially within the sting bed plane 54 throughout the string bed area 38 maximizes the playability of the entire string bed 14, and provides the player with a greater ability to control the ball even on hits closer to the yoke. In other preferred embodiments a portion of the main and or cross strings can extend slight away from the string bed plane 54 near their ends or end regions. The inner and outer peripheral walls 24 and 26 of the hoop 36 preferably include string holes for receiving the racquet string. In a particularly preferred embodiment, the inner peripheral wall 24 is formed with a plurality of main string holes 56 and a plurality of cross string holes 58 for receiving the main and cross string segments 50 and 52, respectively. The string holes 56 and 58 may be circular, oval, rectangular, or any generally curved shape. The string holes 56 and 58 can be sized to be just larger than the diameter of the racquet string, or the combination of the racquet string and the grommet, or a size that is larger to accommodate movement or deflection of the racquet string. The head portion 18 of the racquet 10 can also include one or more grommets or bumper guards for supporting and protecting the racquet string as it extends from one string hole to another.

Preferably, the main string holes 56 formed in the inner peripheral wall 24 of the hoop 36 are positioned such that, when the racquet 10 is strung, each main string segment 50 extends in a direction that is substantially parallel to the longitudinal axis 16 of the racquet 10. The terms substantially parallel or substantially longitudinally extending refers to a direction that is co-linear or parallel to the longitudinal axis 16 plus or minus 2 degrees. Similarly, the cross string holes 58 can be positioned in the inner peripheral wall 24 of the hoop 36 such that, when the racquet 10 is strung, each cross string segment 52 extends in a direction that substantially transverse (or orthogonal) to the longitudinal axis 16 (plus or minus 2 degrees). Accordingly, in a preferred embodiment, the string bed 14 includes a plurality of substantially longitudinally extending main string segments 50 and a plurality of substantially transversely extending cross string segments 52. In other alternative embodiments, main string holes 56 in the inner peripheral wall 24 of the hoop 36 can be positioned such that one or more of the main string segments extend in a direction that is not substantially longitudinal.

In a preferred embodiment, the racquet 10 is configured such that each of the main and cross string holes 56 and 58 includes or receives a single end or end region of one of the main and cross string segments 50 and 52, respectively, and no string hole are left without one of the main or cross string segments extending through it. In a particularly preferred embodiment, two main string holes 56 and two cross string holes 58 are formed in the inner peripheral wall 24 of the hoop 36 to accommodate one separate main string segment 50 and one separate cross-string segment 52, respectively. Therefore, no string holes are left without a main or cross string segment extending through it. In other words, there is no doubling of the string segments through a single string hole, and there are no spare, extra or unused string holes. In another preferred embodiment, one or more of the string holes can be positioned to receive a main and a cross string segment 50 and 52. In another preferred embodiment, two or more main string segments or two or more cross string segments can extend through a single string hole.

Figure 2:
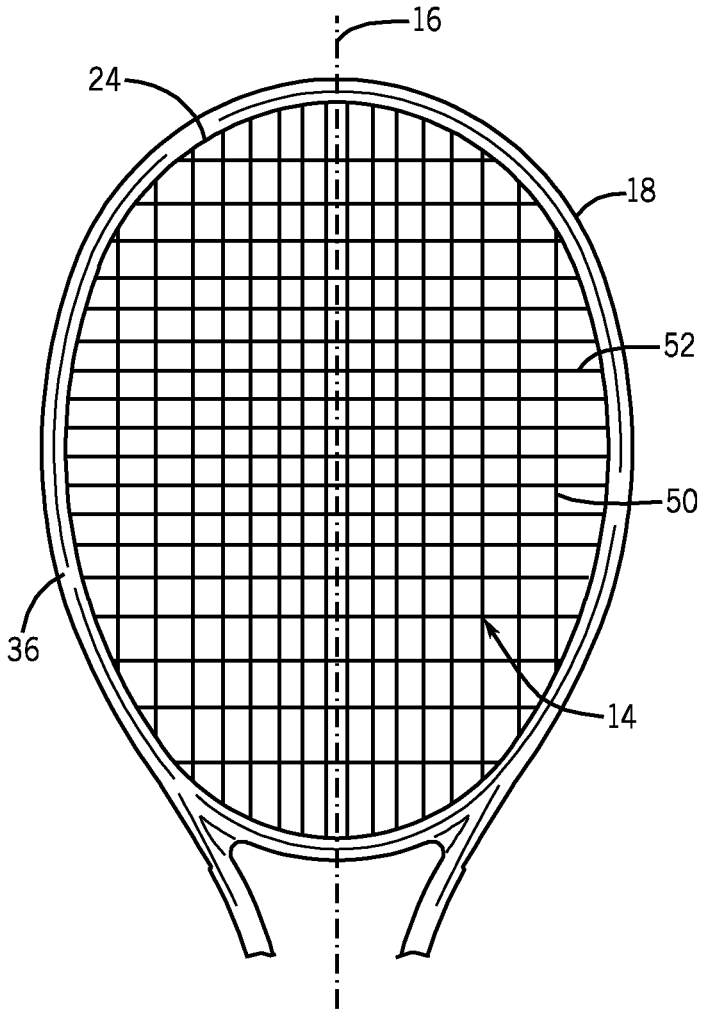
FIG. 2 is a front view of a head portion of a prior art racquet including a string bed.
Figure 3:
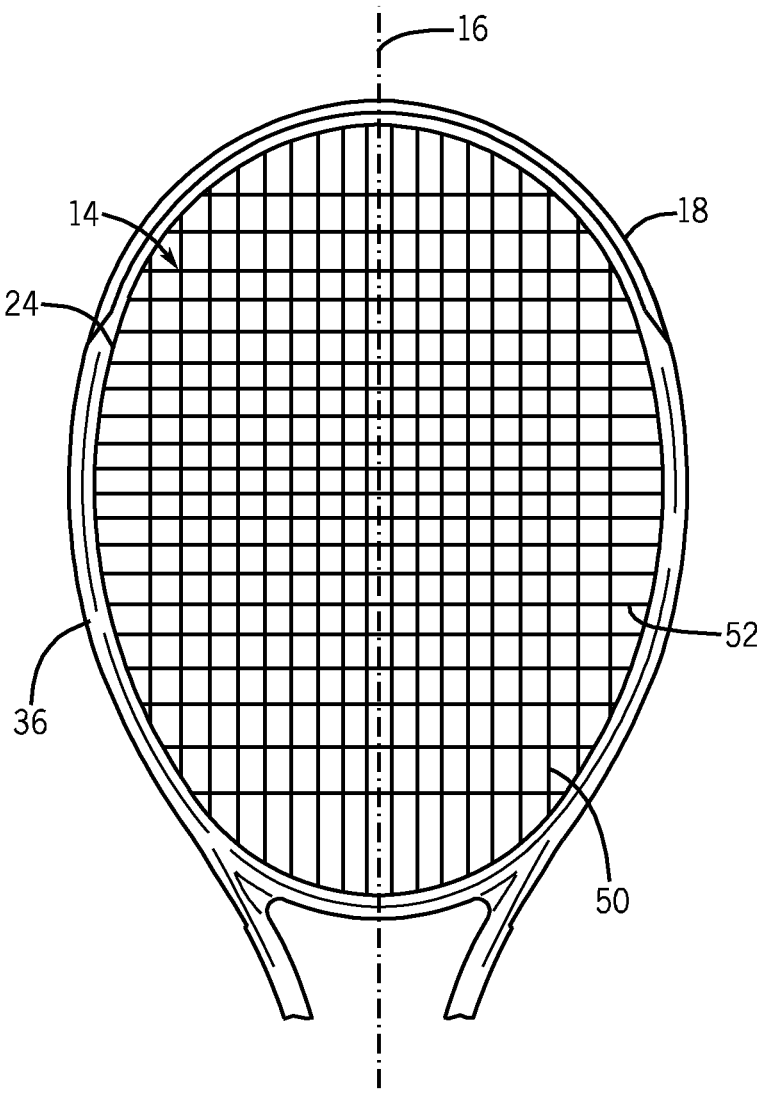
FIG. 3 is a front view of a head portion of another prior art racquet including a string bed.

Referring to FIGS. 2 and 3, the head portions 18 of two prior art racquets is shown. In FIG. 2, the head portion 18 is formed such that the inner peripheral wall of the hoop 36 includes a sufficient number of string holes to provide for a string bed 14 having 16 main string segments 50 and 18 cross string segments 52. The stringing pattern of the racquet of FIG. 2 is referred to as a 16×18 stringing pattern. In FIG. 3, the head portion 18 is formed such that the inner peripheral wall of the hoop 36 includes a sufficient number of string holes to provide for a string bed 14 having 18 main string segments 50 and 20 cross string segments 52. The stringing pattern of the racquet of FIG. 2 is referred to as a 18×20 stringing pattern. Other stringing patterns are also conventionally used such as 14×16, 16×19, 16×20, etc. In conventional stringing patterns, such as the stringing patterns of FIGS. 2 and 3, the number of cross strings is always greater than the number of main strings. In some rare instances a stringing pattern may have an equal number of main and cross string segments. The conventional stringing patterns are necessitated by the non-circular shape of string bed areas and hoops of existing racquets and the strength and durability of the string and frame of the racquet. The non-circular shapes of the hoops of conventional racquets typically result in a maximum longitudinal dimension being greater than the maximum transverse dimension. As such, there is more room or space for cross strings than main strings. In order to distribute the stresses of racquet stringing throughout the head portion and the racquet so that the neither the head portion nor the racquet string fail, it is necessary to add additional transversely extending cross strings to a head portion than longitudinally extending main strings. Conventional racquet design teaches away from an even number of main and cross string segments, because such a design places excessive loads and stress on the racquet string and the head portion itself making such a racquet extremely difficult to string without racquet failure, or play without string failure. Accordingly, over the decades of racquet design, in non-circular head or hoop shapes, the number of cross strings segments is greater than the number of main string segments.

Figure 4:
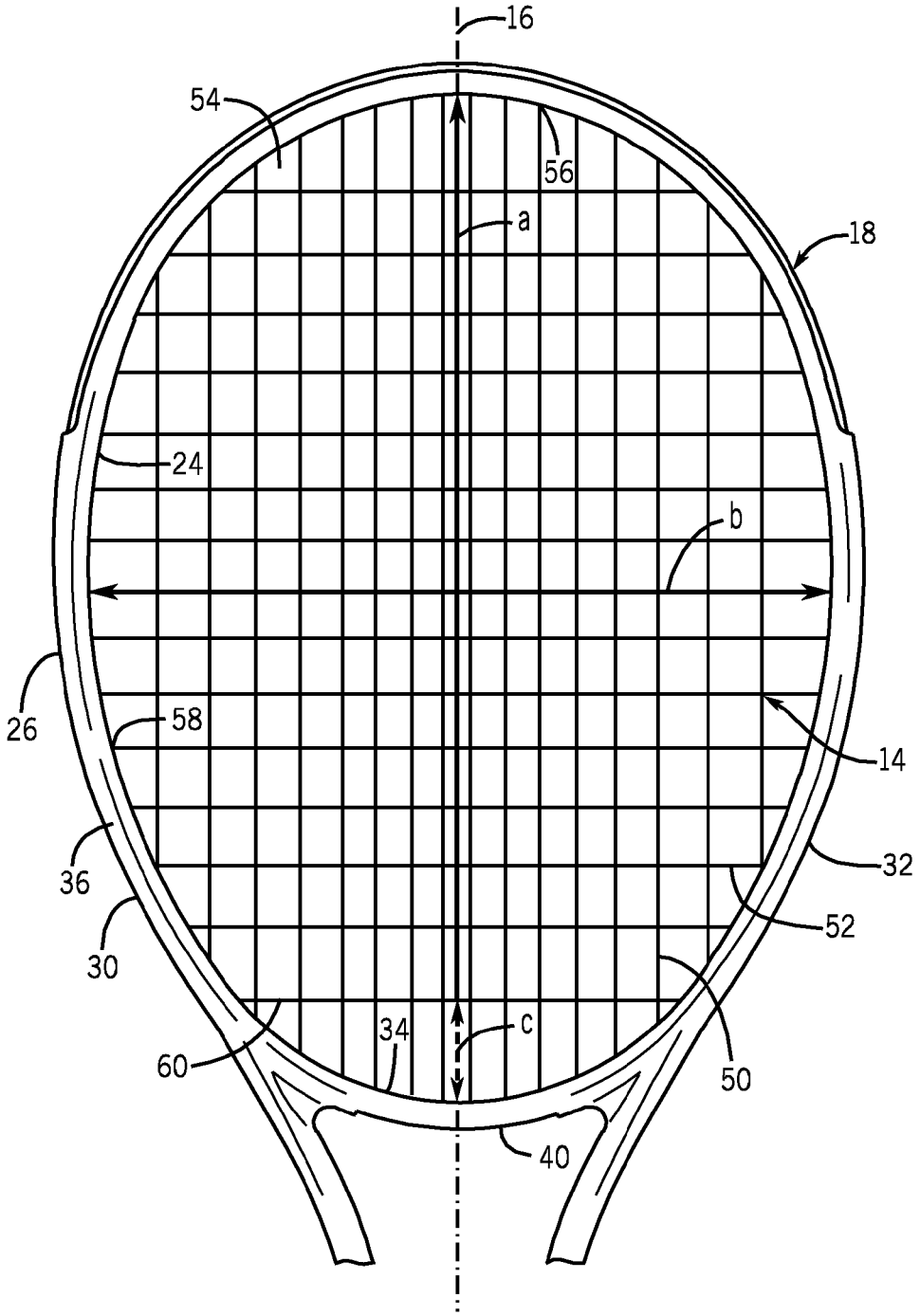
FIG. 4 is a front view of the head portion of the racquet of FIG. 1 including a string bed.
Figure 5:
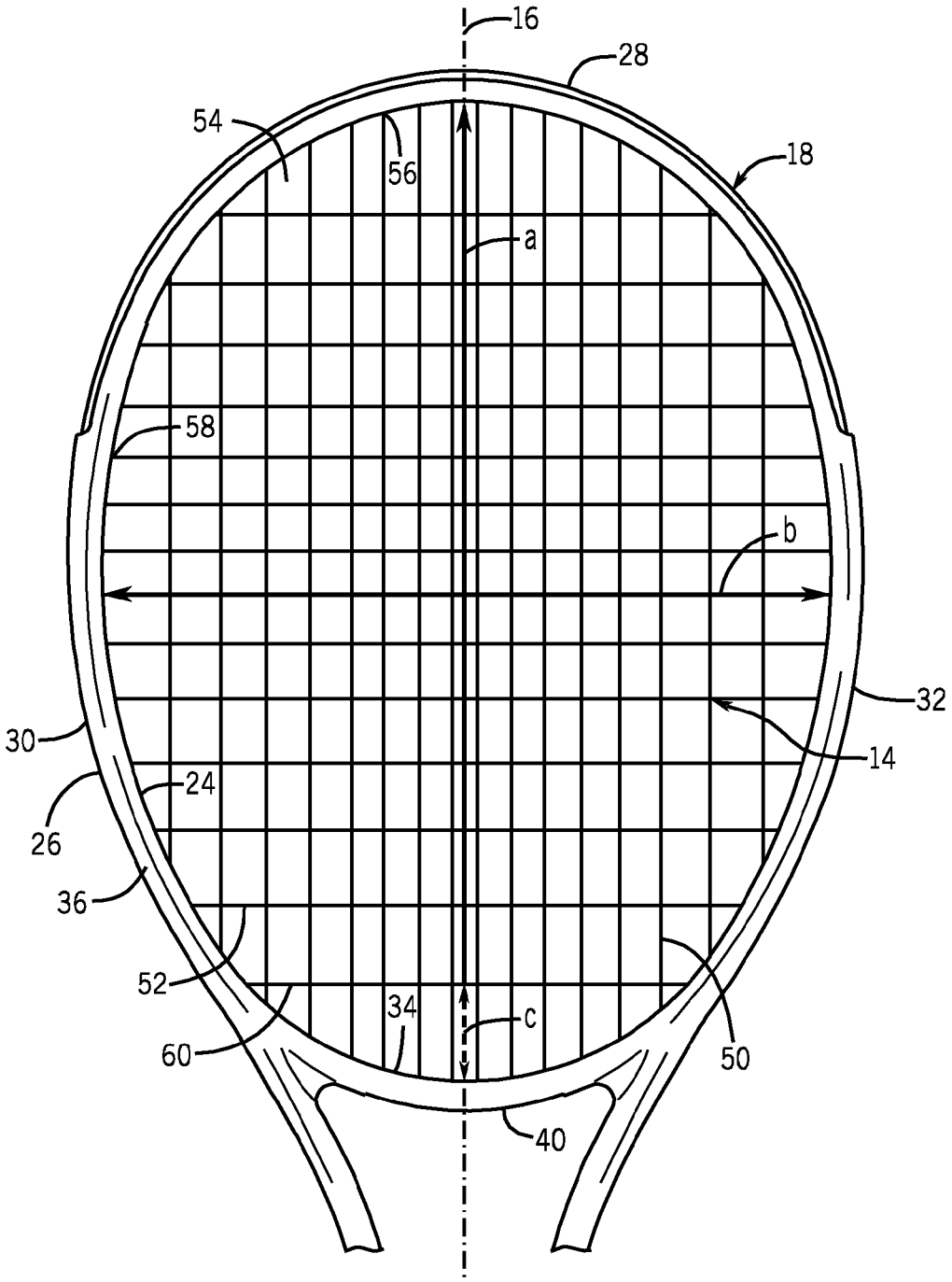
FIG. 5 is a front view of the head portion of the racquet including a string bed in accordance with an alternative preferred embodiment of the present invention.

Referring to FIGS. 3 through 5, head portions 18 of three separate racquets built in accordance with three separate preferred embodiments of the present invention are provided. In FIG. 4, the inner peripheral wall 24 of the hoop 36 of the head portion 18 includes thirty-two (32) main string holes and thirty (30) cross string holes to receive sixteen (16) main string segments 50 and fifteen (15) cross string segments 52, respectively, thereby forming a 16×15 stringing pattern. The pair of cross string holes 58 closest to the handle portion 20 of the racquet 10 define end points of a transverse line 60 extending from the first side region 30 to the second side region 32. The point where the transverse line 60 crosses the longitudinal axis 16 and the end point of the maximum longitudinal dimension a closest to the handle portion 20 define a second longitudinal dimension c. The spacing of the cross string segments 52 in the string bed 14 is optimized such that the ratio of the maximum longitudinal dimension a to the second longitudinal dimension c is at least 6.5 ($a/c \geq 6.5$). In a particularly preferred embodiment, the spacing of the cross string segments 52 in the string bed 14 is optimized such that the ratio of the maximum longitudinal dimension a to the second longitudinal dimension c is at least 7.5 ($a/c \geq 7.5$). Although the 16×15 stringing pattern is illustrated, the present invention contemplates other "minus 1" stringing patterns, such as, 20×19, 18×17, 14×13, etc.

In FIG. 5, the inner peripheral wall 24 of the hoop 36 of the head portion 18 includes thirty-two (32) main string holes and twenty-eight (28) cross string holes to receive sixteen (16) main string segments 50 and fourteen (14) cross string segments 52, respectively, thereby forming a 16×14 stringing pattern. As with the stringing pattern of FIG. 4, the spacing of the cross string segments 52 in the string bed 14 is optimized such that the ratio of the maximum longitudinal dimension a to the second longitudinal dimension c is at least 6.5 ($a/c \geq 6.5$). In a particularly preferred embodiment, the spacing of the cross string segments 52 in the string bed 14 is optimized such that the ratio of the maximum longitudinal dimension a to the second longitudinal dimension c is at least 7.5 ($a/c \geq 7.5$). Although the 16×14 stringing pattern is illustrated, the present invention contemplates other "minus 2" stringing patterns, such as, 20×18, 18×16, 14×12, etc.

Figure 6:
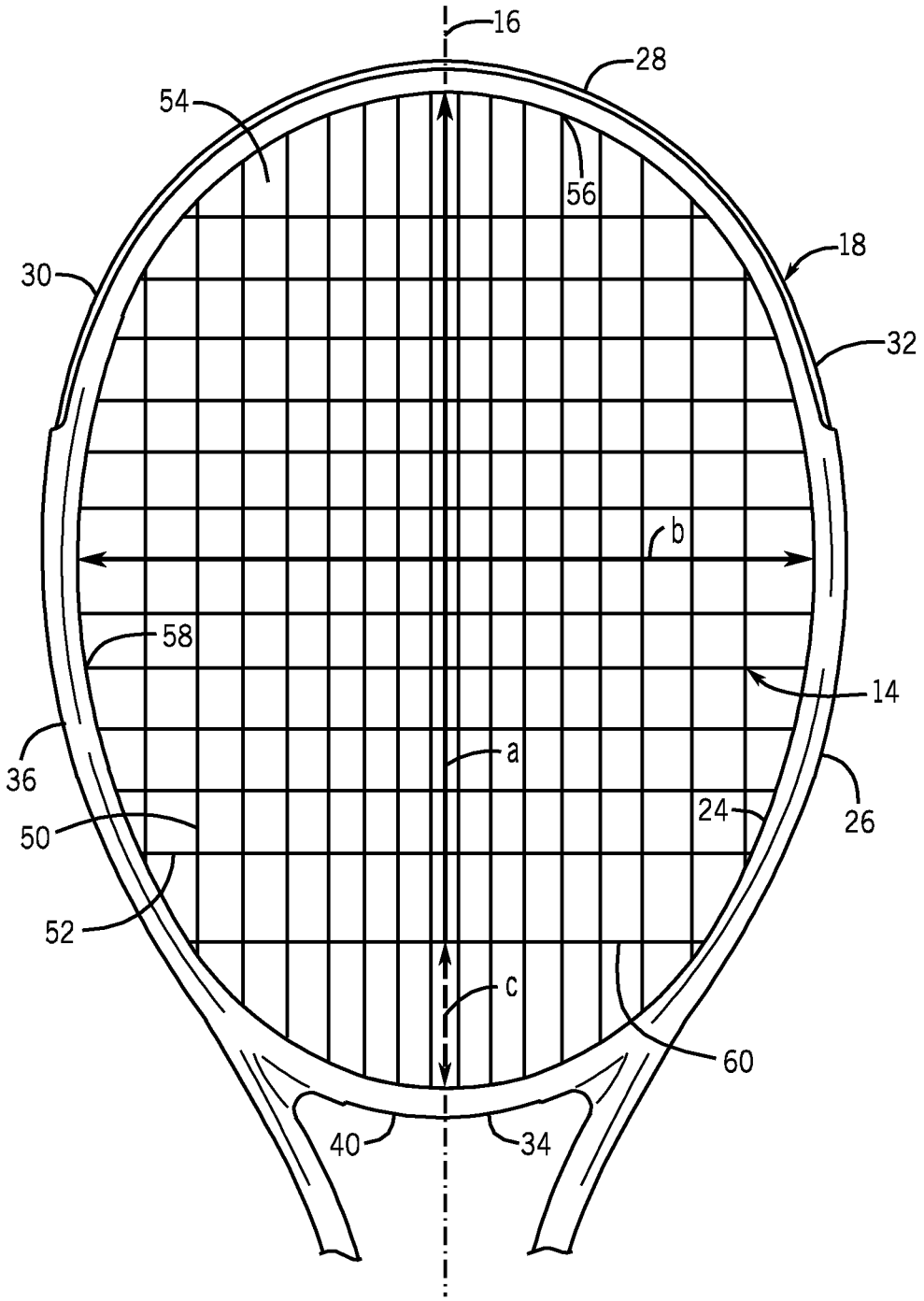
FIG. 6 is a front view of the head portion of the racquet including a string bed in accordance with another alternative preferred embodiment of the present invention.

In FIG. 6, the inner peripheral wall 24 of the hoop 36 of the head portion 18 includes thirty-two (32) main string holes and twenty-six (26) cross string holes to receive sixteen (16) main string segments 50 and thirteen (13) cross string segments 52, respectively, thereby forming a 16×13 stringing pattern. As with the stringing pattern of FIG. 4, the spacing of the cross string segments 52 in the string bed 14 is optimized such that the ratio of the maximum longitudinal dimension a to the second longitudinal dimension c is at least 6.5 (a/c≥6.5). In a particularly preferred embodiment, the spacing of the cross string segments 52 in the string bed 14 is optimized such that the ratio of the maximum longitudinal dimension a to the second longitudinal dimension c is at least 7.5 (a/c≥7.5). Although the 16×13 stringing pattern is illustrated, the present invention contemplates other "minus 3" stringing patterns, such as, 20×17, 18×15, 14×11, etc. In still other preferred embodiments, minus-4, minus-5 and greater stringing patterns may be used. It has been found that by adjusting racquet characteristics, such as maintaining the string bed within the string bed plane across the entire string bed area, positioning the main and cross strings in substantially longitudinal and transverse directions, respectively, incorporating a non-circular head, and optimizing the string spacing, including optimizing the second longitudinal dimension, racquets can be produced with fewer cross strings than main strings without causing premature racquet or string failure.

Racquets built in accordance with the present invention can provide a number of significant advantages to users of the racquets. Racquets built in accordance with the present invention enable a player to impart more spin to the ball than otherwise available with conventional racquet designs. The ability to impart more spin to the ball enables a player to obtain increased spin rates and increased spin ratios. Characteristics such as, snap back velocity of main string segments impacting the ball, and main string deflection can be substantially increased through use of racquets built in accordance with the present invention. The specific configurations of the racquets of the present invention including the shape of the head size, the ratio of the longitudinal dimensions a to c, orientation of the string holes and optimized spacing of the string segments enables all of the above-described characteristics to improve. The increased snap back velocity, and increased string deflection enables the user to impart more spin to the ball thereby improving his or her ability to swing faster, and hit the ball harder while keeping the ball in bounds and to clear the net. Additionally, racquets built in accordance with the present invention can provide the racquet and player with a larger, more powerful sweet spot.

The advantages of the present invention were illustrated in a test performed by Wilson Sporting Goods Co. involving three racquet models during Jun. 20, 2012 through Jul. 6, 2012 at the Wilson Innovation Center Spin Lab in Schiller Park, Ill. The Wilson Innovation Center Spin Lab incorporates the use of the Trackman® Ball Tracking System by Trackman A/S of Vedbaek, Denmark. Two of the racquet models were representative prior art models and the third model was a Wilson® racquet model Steam 99S™ configured with a 16×15 stringing pattern and the other features of the present invention. The first test racquet is a racquet model, Babolat® Pure Drive™, produced by Babolat VS of Lyon, France, and serves as a representative prior art racquet. The second test racquet a Wilson® racquet, model Steam 99™ produced by Wilson Sporting Goods Co. of Chicago, Ill. All three racquets were strung with Luxilon® 4G™ polyester monofilament racquet string having a diameter of 1.25 mm at a tension of 60 lbs. All three racquets were painted black to remove all indicia of brand or model.

Twenty four players of varying ability took 5 to 7 hits with each of the three different racquets. The three racquets were rotated randomly after each hit. Each player was handed one of the three racquets. After each hit, the player randomly received another one of the three racquets, until 5 to 7 recorded hits were obtained from each player hitting each racquet. The data reduction methodology included the following requirements.

1. A shot must have a recorded spin rate
2. The ball must go over the net
3. Shot length must be less than 88 feet
4. Shot must land +/−18 feet of centerline left and right
5. Must have a ball speed >40 mph to eliminate some frame hits
6. A player must have at least three recordable shots for each of the three racquets

TABLE 1

TEST RESULTS
1. Spin, Speed, Launch Statistics

| 24 players | Babolat Puredrive | Wilson Steam 99 | Wilson Steam 99S | | Puredrive vs Steam 99S | Steam 99 vs Steam 99S |
|---|---|---|---|---|---|---|
| BALL SPEED (mph) | | | | | | |
| AVG | 64.9 | 66.3 | 66.2 | | −1.3 | 0.1 |
| STDEV | 7.2 | 6.5 | 7.0 | | 3.1 | 2.3 |
| | | | | 95% Confidence Interval | ±1.30 | ±0.96 |
| | | | | | SIGNIFICANT | |
| BALL SPIN (mph) | | | | | | |
| AVG | 1360.2 | 1394.9 | 1501.7 | | −141.4 | −106.8 |
| STDEV | 402.8 | 305.2 | 305.6 | | 274.9 | 226.4 |
| | | | | 95% Confidence Interval | ±134.56 | ±95.61 |
| | | | | | SIGNIFICANT | SIGNIFICANT |
| LAUNCH ANGLE (deg) | | | | | | |
| AVG | 9.6 | 9.9 | 10.4 | | −0.8 | −0.5 |
| STDEV | 2.2 | 2.1 | 2.6 | | 1.0 | 1.8 |
| | | | | 95% Confidence Interval | ±0.41 | ±0.76 |

TABLE 1-continued

| TEST RESULTS 1. Spin, Speed, Launch Statistics | | | | | | |
|---|---|---|---|---|---|---|
| 24 players | Babolat Puredrive | Wilson Steam 99 | Wilson Steam 99S | | Puredrive vs Steam 99S | Steam 99 vs Steam 99S |
| TRAJ HEIGHT (in) | | | | | | |
| AVG | 79.9 | 84.0 | 89.1 | | −9.3 | −5.1 |
| STDEV | 13.2 | 12.5 | 16.4 | | 7.9 | 14.4 |
| | | | | 95% Confidence Interval | ±3.35 | ±6.09 |
| | | | | | SIGNIFICANT | |
| Landing ANGLE (deg) | | | | | | |
| AVG | 22.4 | 23.2 | 24.3 | | −1.9 | −1.1 |
| STDEV | 3.6 | 3.4 | 4.4 | | 1.9 | 3.7 |
| | | | | 95% Confidence Interval | ±0.8 | ±1.6 |
| | | | | | SIGNIFICANT | |

The results of the Player Test of the three racquets showed the racquet built in accordance with the present invention provided significantly improved ball speed, ball spin, launch angle, trajectory height and landing angle than the two prior art racquet models (see Table 1). The racquet built in accordance with the present invention improved the players' ability to impart spin to the ball during the test and therefore enabled the players to increase the ball speed, the ball spin, and improve the balls trajectory and launch angle. The result is that players can hit the ball harder and faster and keep it in play and generate increased trajectory thereby allowing the ball to clear the net and stay in play.

Table 2 below provides a set of flight predictions developed by Wilson Sporting Goods Co. using a Wilson Trajectory Model for tennis balls. The calculated results of the Wilson Trajectory Model are consistent with measured Doppler radar results of impacted tennis balls. The Model shows the potential significant benefits that can be achieved from an increase in spin rate imparted to a tennis ball following impact with a racquet.

TABLE 2

| Launch Ball Speed (mph) | Launch Top Spin (rpm) | Launch Angle (deg) | Flight Distance Travel (feet) | Avg Flight Distance Reduction per 100 rpm (feet) | Avg Flight Distance Reduction per 100 rpm (INCHES) |
|---|---|---|---|---|---|
| 60 | 1000 | 10 | 65.5 | 0.52 | 6.3 |
| 60 | 2000 | 10 | 59.2 | | |
| 60 | 3000 | 10 | 54.0 | | |
| 60 | 4000 | 10 | 49.8 | | |
| 75 | 1000 | 10 | 85.8 | 0.75 | 9.0 |
| 75 | 2000 | 10 | 76.7 | | |
| 75 | 3000 | 10 | 69.4 | | |
| 75 | 4000 | 10 | 63.4 | | |
| 90 | 1000 | 10 | 105.9 | 0.97 | 11.6 |
| 90 | 2000 | 10 | 94.0 | | |
| 90 | 3000 | 10 | 84.4 | | |
| 90 | 4000 | 10 | 76.7 | | |

Accordingly, for every increase in spin rate of 100 rpm imparted to a tennis ball as top spin, a corresponding reduction in distance traveled until impacting the court on a typical groundstroke of 6 to 12 inches is found depending upon the speed of the groundstroke.

Figure 7:
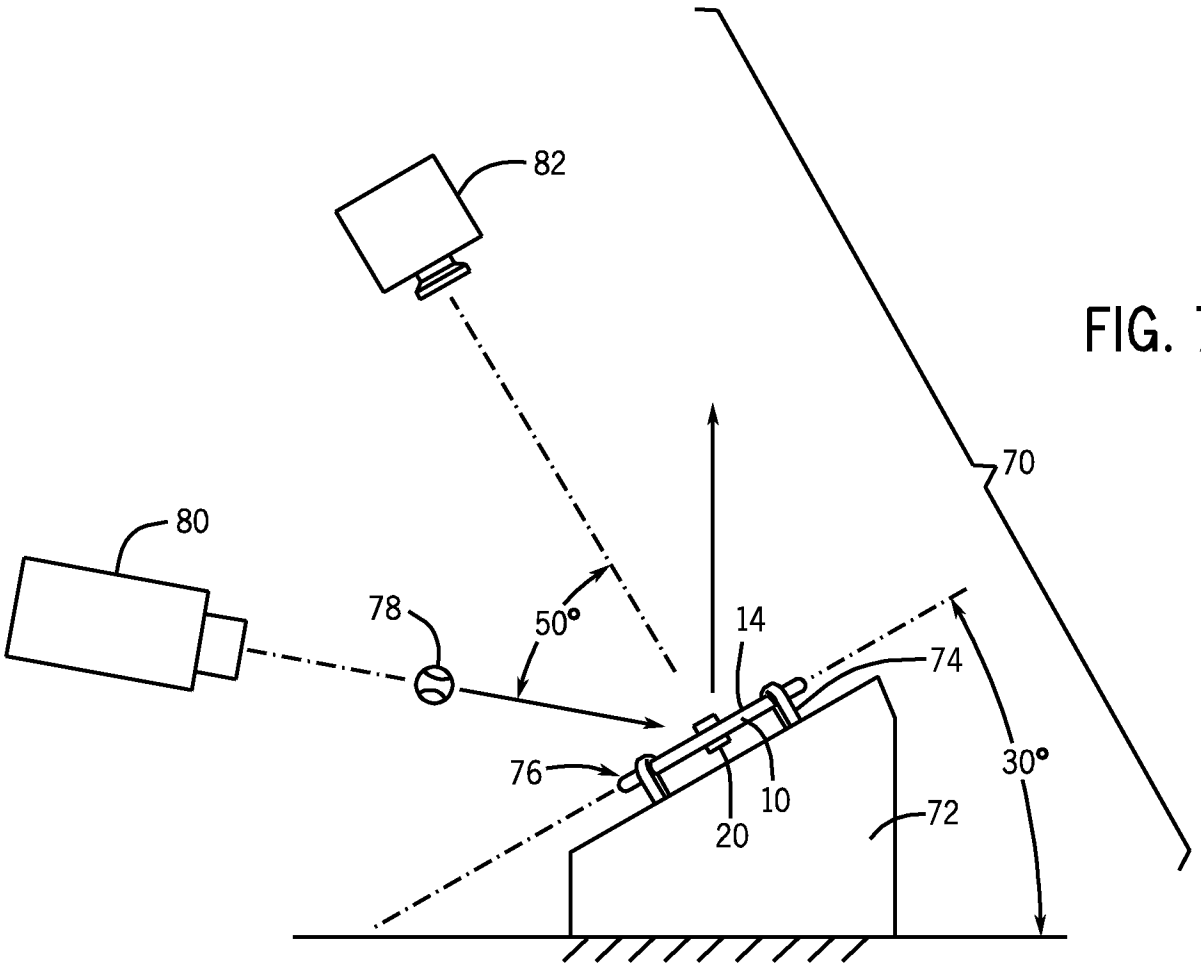
FIG. 7 is a side view of a tennis ball spin test set-up.

Referring to FIG. 7, Wilson Sporting Goods Co. also conducted a tennis ball spin test using a spin test assembly 70. Under the tennis ball spin test, the racquet 10 was securely mounted to a test fixture 72 by four spaced apart mounts 74 such that a plane defined by a string bed 76 is positioned 30 degrees from horizontal, a tennis ball 78 is projected from a ball projecting machine 80 to the string bed 14 at a speed within the range of 38 to 42 miles per hour from an angle that is 50 degrees from an axis normal to the plane of the string bed, and the ball and the string bed are monitored under a high speed video system 82 at 5000 frames per second. The ball projecting machine 80 is configured to impart a spin on the ball as it exits the ball projecting machine. One example of such a machine is an ATEC® Casey® Pro 3G™ pitching machine produced by Athletic Training Equipment Company of Sparks, Nev. The high speed video is positioned at one or more locations to allow for optimal recording of tennis ball spin and/or string segment movement (deflection). The high speed video system is shown in one position in FIG. 7. In other preferred configurations, the video system can be positioned at an alternative position. The results of the Wilson tennis ball spin test found significant improvement in spin rate and spin ratio of tennis balls following impact with a racquet built in accordance with the present invention over other existing racquet configurations.

Figure 8:
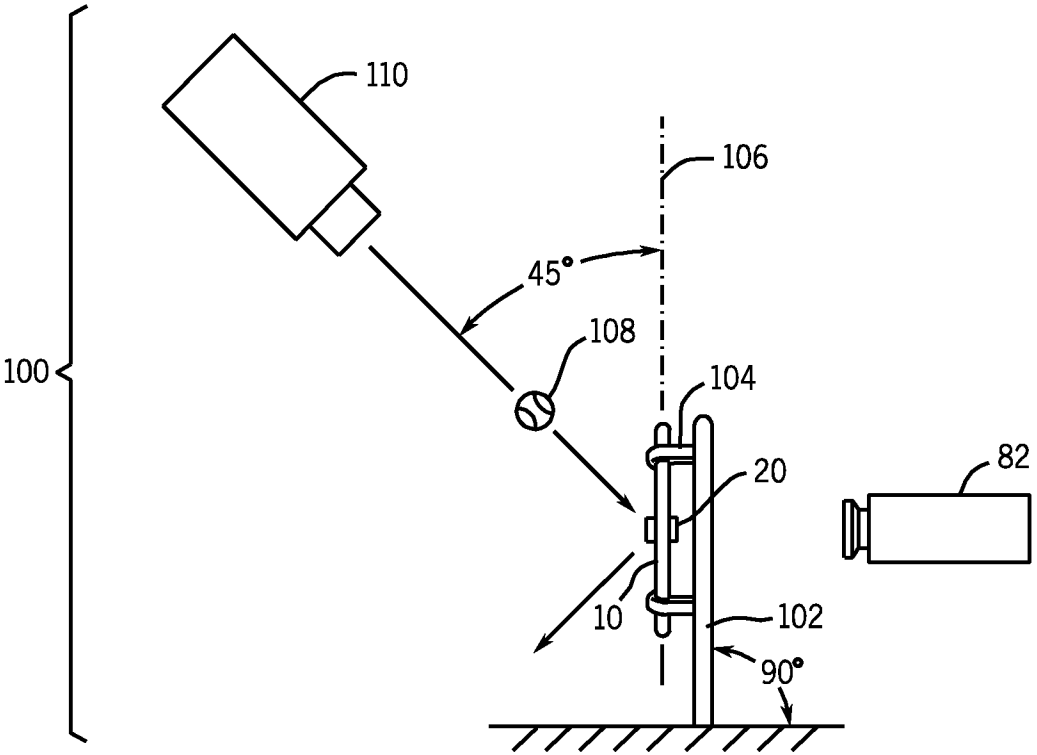
FIG. 8 is a side view of a racquet displacement test set-up.

Referring to FIG. 8, Wilson Sporting Goods Co. also conducted a tennis ball displacement test using a displacement test assembly 100. Under the tennis ball spin test, the racquet 10 was securely mounted to a test fixture 102 by four spaced apart mounts 104 such that a plane defined by a string bed 106 is positioned 90 degrees from horizontal (or vertically), a tennis ball 108 is projected from a ball projecting machine 110 to the string bed 14 at a speed of approximately 60 feet per second from an angle that is 45 degrees from an axis normal to the plane of the string bed, and the ball and the string bed are monitored under the high speed video system 82 at 5000 frames per second. The ball projecting machine 110 is preferably an air cannon. The high speed video is positioned at one or more locations to allow for optimal recording of tennis ball spin and/or string segment movement (deflection). The high speed video system is shown in one position in FIG. 8. In other preferred configurations, the video system can be positioned in one or more alternative positions. The results of the Wilson tennis displacement spin test found significant improvement in string deflection of a main string impacted by the tennis ball, and snapback time and velocity of main strings impacted by a ball.

The Wilson Tennis Ball Spin Test and the Wilson Displacement Test were conducted on four racquet models. Three of the racquet models were representative prior art models and the fourth model was a Wilson® racquet model Steam 99™ having a head size of 99 square inches, and configured with a 16×15 stringing pattern and the other features of the present invention. The first test racquet is a racquet model, Babolat® Pure Drive™, produced by Babolat VS of Lyon, France, and serves as a representative prior art racquet. The second test racquet is a racquet model, Babolat® Aero Pro Drive™, produced by Babolat VS of Lyon, France, and serves as a representative prior art racquet. The third test racquet a Wilson® racquet, model Steam 100™ having a head size of 100 square inches and produced by Wilson Sporting Goods Co. of Chicago, Ill. All four racquets were strung with Luxilon® 4G™ polyester monofilament racquet string having a diameter of 1.25 mm at a tension of 60 lbs.

In the Wilson Tennis Ball Spin Test, the inbound angular speeds of the projected tennis balls were approximately 1400 rpm. The rebound speeds were 20 to 30 miles per hour. The bounce angle was 80 to 90 degrees from horizontal (vertical or close to vertical).

The high speed camera 82 can be placed perpendicular to the path of the ball 78, 3 feet from the racquet fixture 72, or can be positioned at other locations (such as pointed at the side of the racquet frame) to provide desired images for measurement. The camera 82 is focused on the point of contact (center of the string bed 14). Video is recorded at 5000 frames per second to record as many ball locations as possible without sacrificing video quality.

Wilson® US Open® tennis balls with a quadrant logo are used in this test to aid in tracking with the high speed video analysis software TEMA. The quadrant option provides a location on the balls' quadrant icon and allowing the spin rate to be tracked throughout the path of motion of the ball. This data was transferred to an excel template that averages speeds and spin rates for the portions of the video that show the most consistency. Six videos were recorded for each racquet/string/pattern tested.

Figure 12:
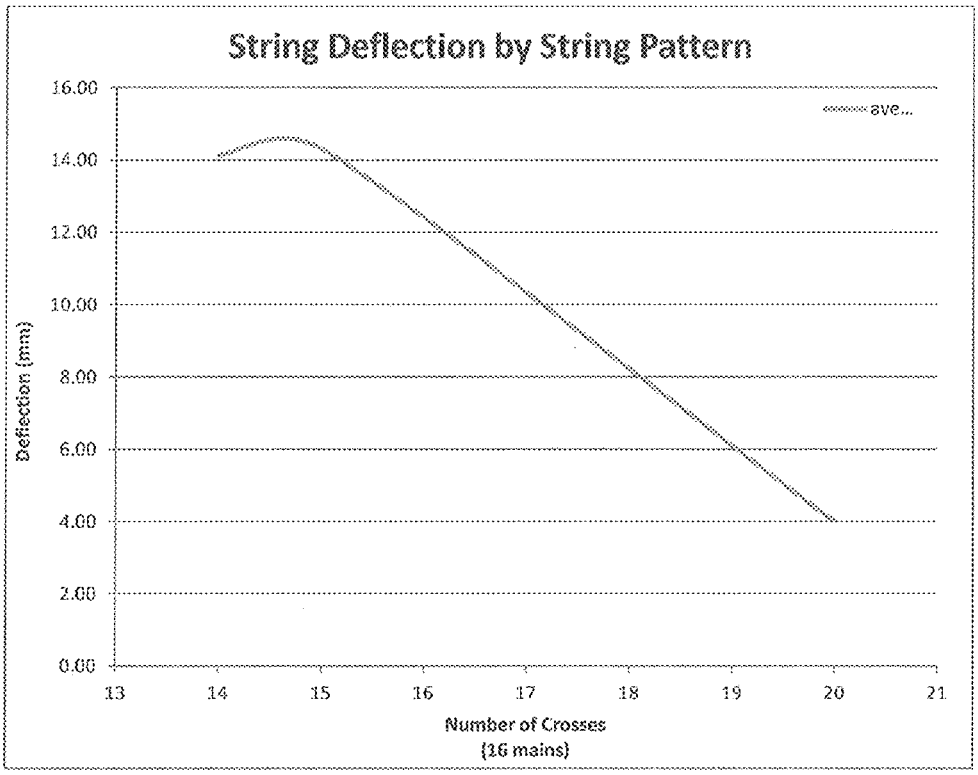
FIG. 12 is a graph of the average string deflection data of Table 3 for racquets strung with varying numbers of cross-strings.
Figure 13:
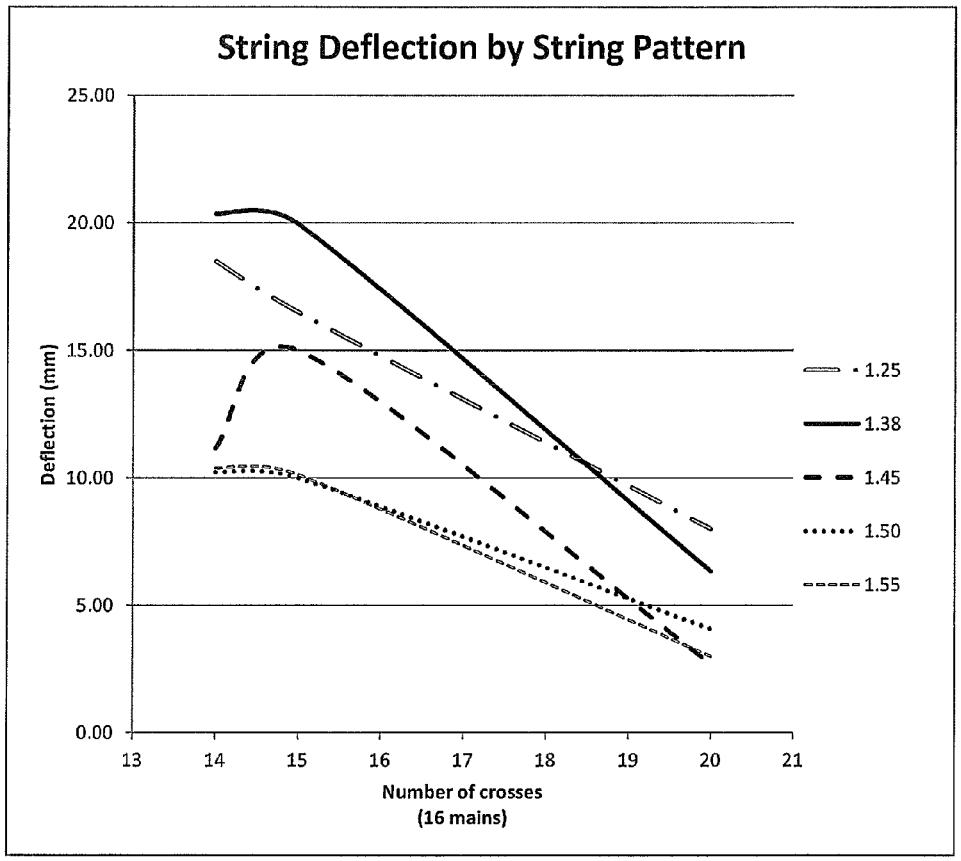
FIG. 13 is a graph of the string deflection data of Table 4 for racquets strung with varying numbers of cross-strings and different racquet string diameters.
Figure 14:
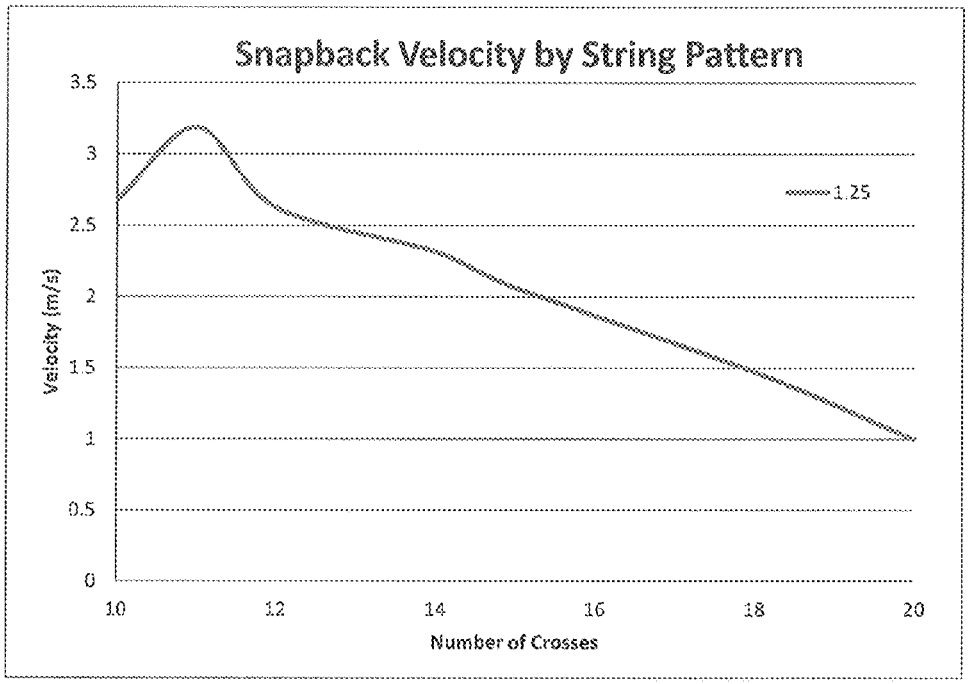
FIG. 14 is a graph of racquet string snapback velocity measurements of Table 6 for racquets strung with varying numbers of cross-strings.
Figure 15:
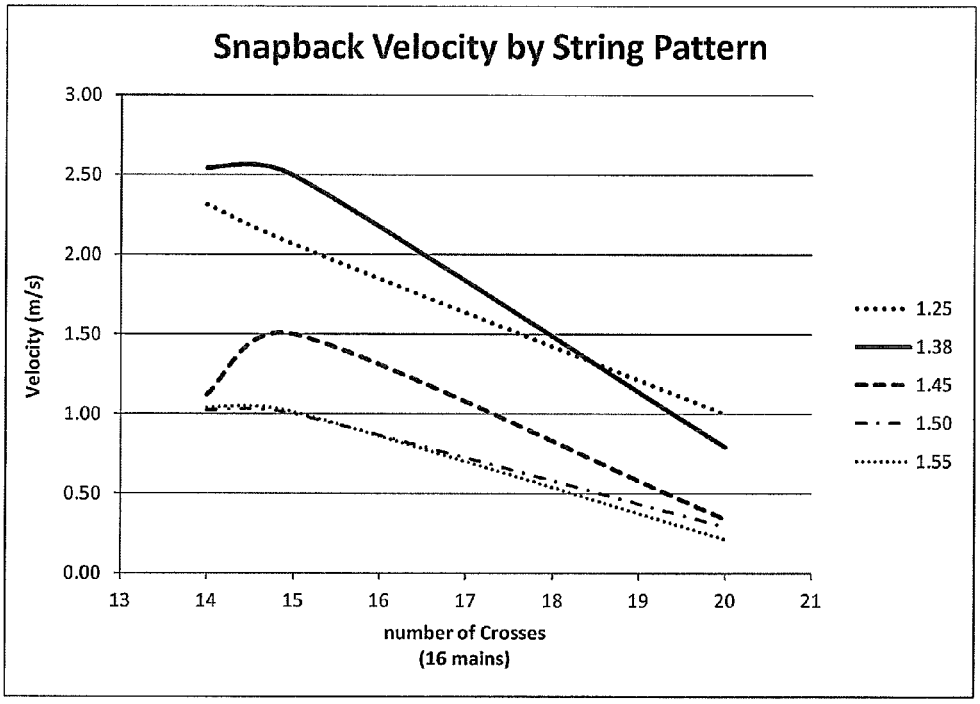
FIG. 15 is a graph of racquet string snapback velocity measurements of Table 7 for racquets strung with varying numbers of cross-strings and different string diameters.
Figure 16:
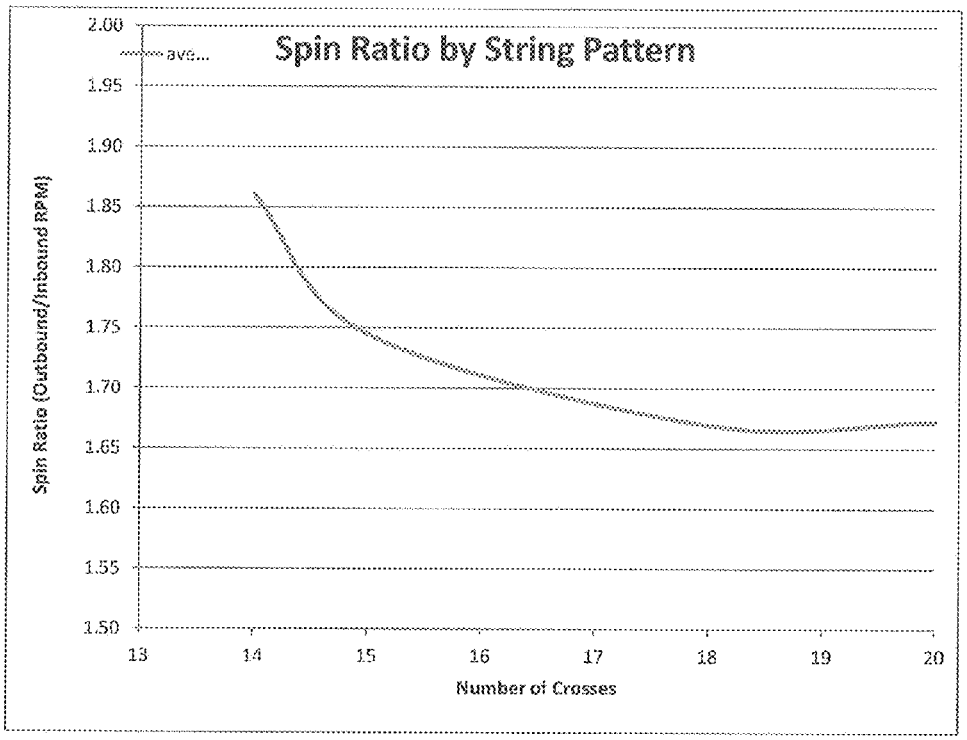
FIG. 16 is a graph of spin ratio data of Table 8 for racquets strung with varying numbers of cross-strings.

The Wilson Tennis Ball Spin Test and Wilson Displacement Tests were also conducted on a series of Wilson® Six One® racquets having the same frame and hoop geometry and size (105 sq. inches), and varying string patterns. Each racquet was configured with 16 main string segments and a different number of cross string segments. The racquets incorporated a planar string bed across the stringing area, substantially longitudinally and substantially transervely extending main and cross string segments, respectively, and optimized cross string spacing for those racquets with reduced quantities of cross string segments. The following results for String Deflection (Tables 3 & 4 and FIGS. 12 and 13), Snap Back Time (Table 5), Snap Back Velocity (Tables 6 & 7 and FIGS. 14 and 15), and Spin Rate (Table 8 and FIG. 16) were obtained from testing the series of Wilson® Six One® racquets under the Wilson Tennis Ball Spin Test.

TABLE 3

| String Diameter (mm) | String Pattern | String Deflection (mm) |
|---|---|---|
| 1.25 | 16 × 11 | 23.54 |
| | 16 × 12 | 23.60 |
| | 16 × 14 | 18.50 |
| | 16 × 15 | 16.50 |
| | 16 × 18 | 6.04 |
| | 16 × 20 | 8.00 |
| 1.38 | 16 × 14 | 20.36 |
| | 16 × 15 | 19.95 |
| | 16 × 20 | 6.35 |
| 1.45 | 16 × 14 | 11.17 |
| | 16 × 15 | 15.00 |
| | 16 × 20 | 2.72 |
| 1.50 | 16 × 14 | 10.24 |
| | 16 × 15 | 10.00 |
| | 16 × 20 | 4.09 |
| 1.55 | 16 × 14 | 10.40 |
| | 16 × 15 | 10.13 |
| | 16 × 20 | 3.00 |

TABLE 4

| String Deflection: | |
|---|---|
| | Average String Deflection (mm) |
| 1.25 | |
| 16 × 14 | 18.50 |
| 16 × 15 | 16.50 |
| 16 × 20 | 8.00 |
| 1.38 | |
| 16 × 14 | 20.36 |
| 16 × 15 | 19.95 |
| 16 × 20 | 6.35 |
| 1.45 | |
| 16 × 14 | 11.17 |
| 16 × 15 | 15.00 |
| 16 × 20 | 2.72 |
| 1.50 | |
| 16 × 14 | 10.24 |
| 16 × 15 | 10.00 |
| 16 × 20 | 4.09 |
| 1.55 | |
| 16 × 14 | 10.40 |
| 16 × 15 | 10.13 |
| 16 × 20 | 3.00 |

TABLE 5

| String Diameter (mm) | String Pattern | Snapback Time (s) |
|---|---|---|
| 1.25 | 16 × 11 | 0.00738 |
| | 16 × 12 | 0.00900 |
| | 16 × 14 | 0.00800 |
| | 16 × 15 | 0.00800 |
| | 16 × 18 | 0.00410 |
| | 16 × 20 | 0.00800 |
| 1.38 | 16 × 14 | 0.00800 |
| | 16 × 15 | 0.00800 |
| | 16 × 20 | 0.00800 |
| 1.45 | 16 × 14 | 0.00997 |
| | 16 × 15 | 0.01000 |
| | 16 × 20 | 0.00801 |
| 1.50 | 16 × 14 | 0.01000 |
| | 16 × 15 | 0.01000 |
| | 16 × 20 | 0.01399 |
| 1.55 | 16 × 14 | 0.01000 |
| | 16 × 15 | 0.01000 |
| | 16 × 20 | 0.01402 |

TABLE 6

| String Diameter (mm) | String Pattern | Snap Back Velocity (m/s) |
|---|---|---|
| 1.25 | 8 × 10 | 2.79 |
| | 8 × 20 | 1.787 |
| | 10 × 20 | 1.261 |
| | 16 × 10 | 2.675 |
| | 16 × 11 | 3.19 |
| | 16 × 12 | 2.62 |
| | 16 × 14 | 2.31 |
| | 16 × 15 | 2.06 |
| | 16 × 18 | 1.47 |
| | 16 × 20 | 1.00 |
| 1.38 | 16 × 14 | 2.55 |
| | 16 × 15 | 2.49 |
| | 16 × 20 | 0.79 |
| 1.45 | 16 × 14 | 1.12 |
| | 16 × 15 | 1.50 |
| | 16 × 20 | 0.34 |
| 1.50 | 16 × 14 | 1.02 |
| | 16 × 15 | 1.00 |
| | 16 × 20 | 0.29 |
| 1.55 | 16 × 14 | 1.04 |
| | 16 × 15 | 1.01 |
| | 16 × 20 | 0.21 |

TABLE 7

| Snapback Velocity: | |
|---|---|
| | String Snap Back Velocity (m/s) |
| 1.25 | |
| 16 × 14 | 2.31 |
| 16 × 15 | 2.06 |
| 16 × 20 | 1.00 |
| 1.38 | |
| 16 × 14 | 2.55 |
| 16 × 15 | 2.49 |
| 16 × 20 | 0.79 |
| 1.45 | |
| 16 × 14 | 1.12 |
| 16 × 15 | 1.50 |
| 16 × 20 | 0.34 |

TABLE 7-continued

| Snapback Velocity: | |
|---|---|
| | String Snap Back Velocity (m/s) |
| 1.50 | |
| 16 × 14 | 1.02 |
| 16 × 15 | 1.00 |
| 16 × 20 | 0.29 |
| 1.55 | |
| 16 × 14 | 1.04 |
| 16 × 15 | 1.01 |
| 16 × 20 | 0.21 |

TABLE 8

| String Diameter (mm) | String Pattern | Spin Ratio |
|---|---|---|
| 1.25 | 16 × 14 | 1.81 |
| | 16 × 15 | 1.71 |
| | 16 × 18 | 1.66 |
| | 16 × 20 | |
| 1.38 | 16 × 14 | 1.81 |
| | 16 × 15 | 1.73 |
| | 16 × 18 | 1.62 |
| | 16 × 20 | 1.64 |
| 1.45 | 16 × 14 | 1.96 |
| | 16 × 15 | 1.70 |
| | 16 × 18 | 1.64 |
| | 16 × 20 | 1.63 |
| 1.50 | 16 × 14 | |
| | 16 × 15 | 1.84 |
| | 16 × 18 | 1.76 |
| | 16 × 20 | 1.75 |

The test results summarized in Tables 3-8 demonstrate the significant beneficial performance characteristics that result from racquets produced in accordance with the present invention. Tables 3 and 4 (and FIGS. 12 and 13) illustrate that the racquets configured in accordance with the present invention having fewer cross string segments exhibited greater main string segment deflection than racquets having a greater number of cross string segments. Main string deflection is a measure of the movement of the main string upon impact with a tennis ball. The greater the deflection the greater the ability of the string to impart spin to the ball. The test data showed that with racquet string having a string diameter within the range of 1.25 to 1.55 mm, the string deflection of a main string segment contacting a tennis ball in the Wilson Spin Test is at least 5 mm. Further, the string deflection can be at least 10 mm, and can extend over 20 mm.

The terms snap back time and snap back velocity refer to the time and velocity of the main string segment as it returns from its maximum deflection point to its original position prior to impact. Snap back time and velocity are inversely proportional. As snap back time decrease, snap back velocity increases. Snap back time and velocity can be used to measure a string bed's and racquet's ability to impart spin to a tennis ball. Tables 5 through 7 (and FIGS. 14 and 15) illustrate that the racquets built in accordance with the preferred invention having a reduced number of cross string segments exhibited generally decreased snap back time, and significantly increased snap back velocities. The increased snap back velocity increases the likelihood that the main string segment will snap back at least partially while the tennis ball remains in contact with the string bed upon impact. The higher the snap back velocity, the greater the spin that can be imparted to the ball by the snapping back or returning of the main string segment to its original position. The test data showed that with racquet string having a string diameter within the range of 1.45 to 1.55 mm, at least one of the main string segments contacting the tennis ball exhibits a snap back velocity of at least 1 meter per second. Further, the test data showed that with racquet string having a string diameter within the range of 1.25 to 1.38 millimeters, at least one of the main string segments contacting the tennis ball exhibits a snap back velocity of at least 2 meter per second.

Table 8 (and FIG. 16) illustrates that the racquets built in accordance with the preferred invention can provide an increased spin ratio. Spin rate is a measure the spin of a tennis ball. Spin ratio is the ratio of the spin rate of a tennis ball after impact with the tennis racquet to the spin rate of the tennis ball prior to impact with the tennis racquet. The higher the spin ratio, the greater the spin that was imparted to the ball. The test data showed that with racquet string having a string diameter within the range of 1.25 to 1.55 mm, the ratio of the outbound spin rate to the inbound spin rate is at least 1.67. Further, the test data showed that with racquet string having a string diameter of approximately 1.5 millimeters, the ratio of the outbound spin rate to the inbound spin rate is at least 1.8.

Figure 9:
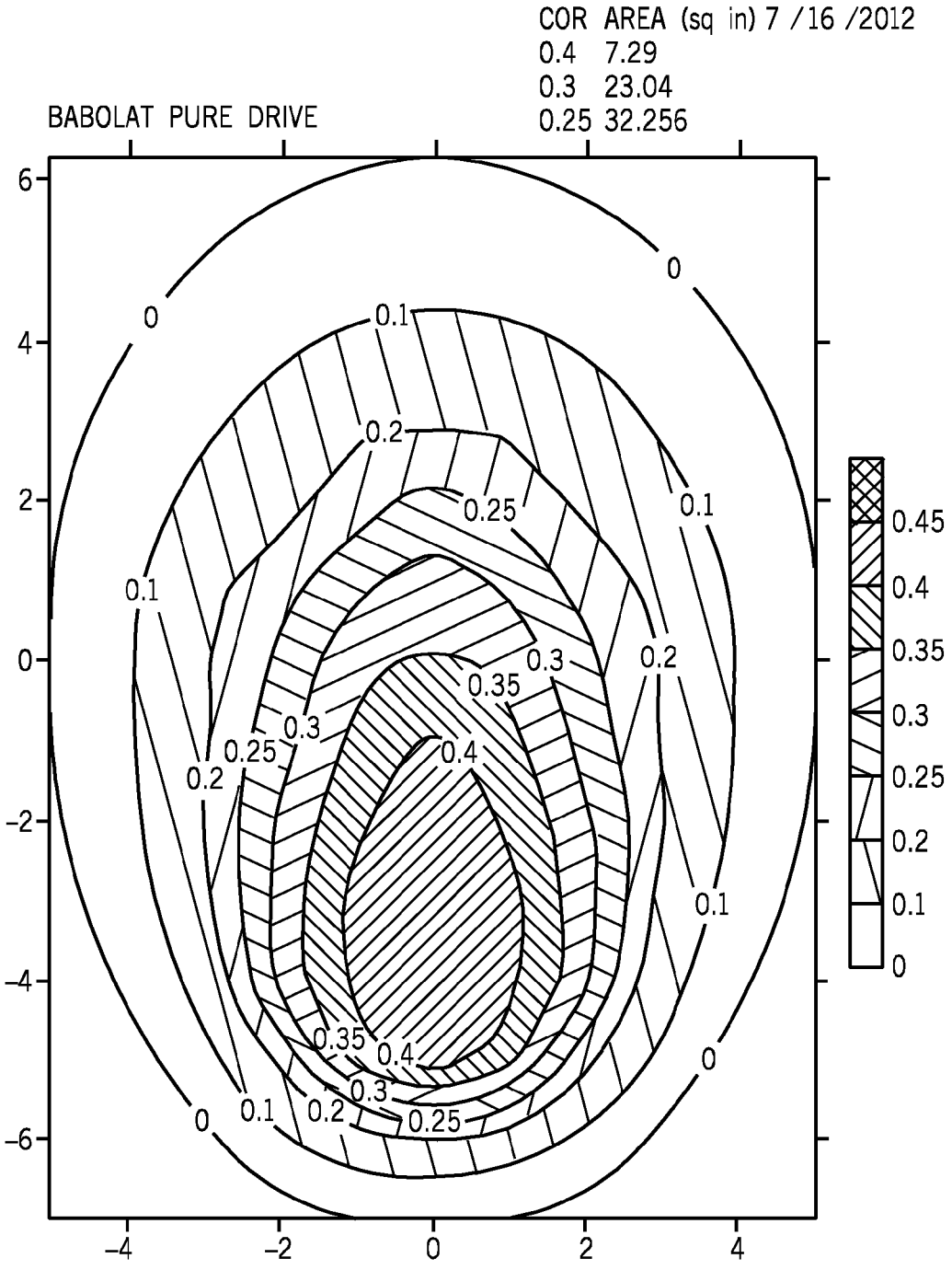
FIG. 9 is a two dimensional mapping of the coefficients of restitution on the string bed of a representative prior art racquet.
Figure 10:
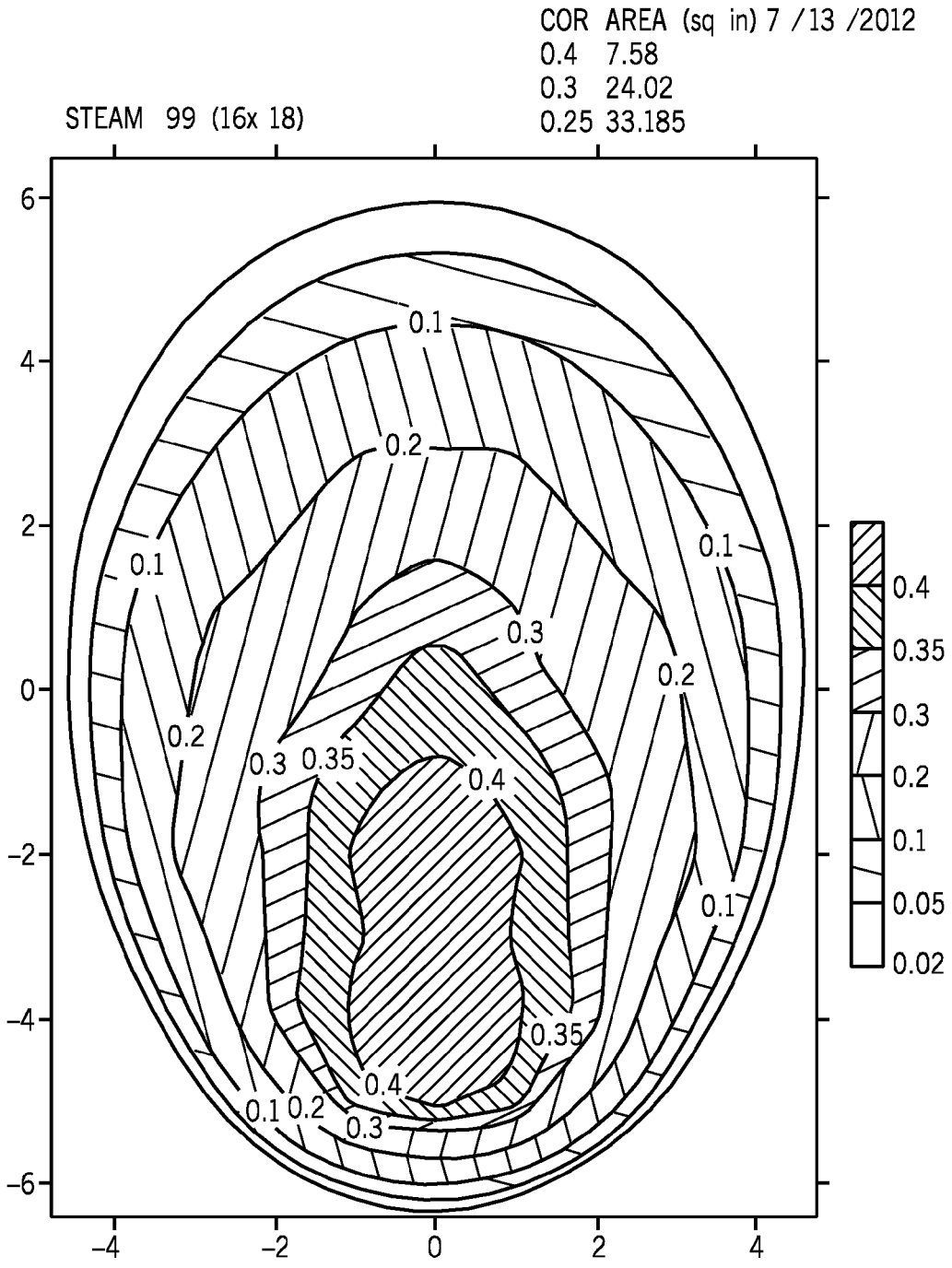
FIG. 10 is a two dimensional mapping of the coefficients of restitution on the string bed of a racquet substantially similar to the racquet of FIG. 2.
Figure 11:
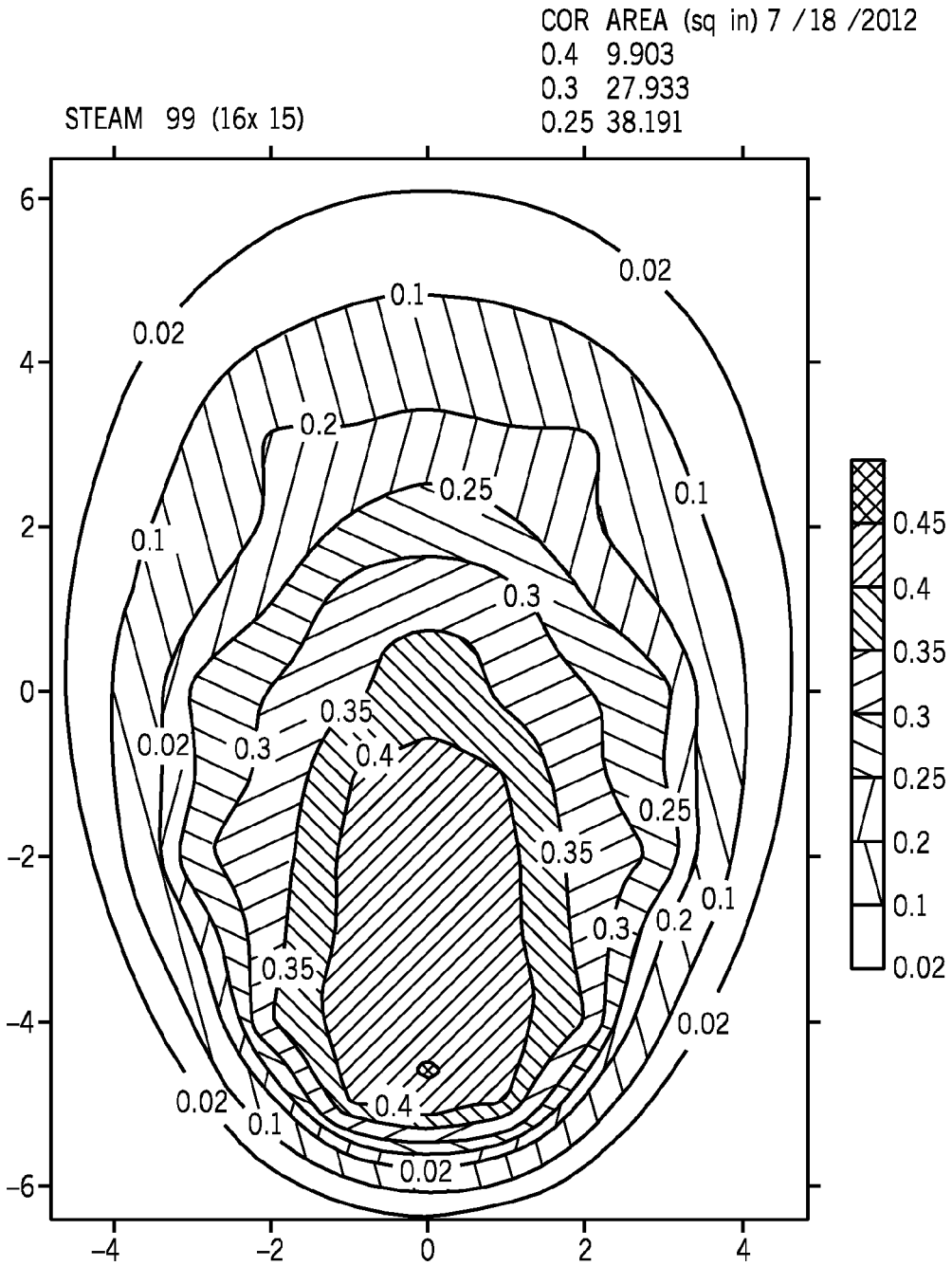
FIG. 11 is a two dimensional mapping of the coefficients of restitution on the string bed of a racquet substantially similar to the racquet of FIG. 4.

Referring to FIGS. 9-11, the enlarged sweet spot obtained through incorporation of the present invention into a racquet is demonstrated. FIGS. 9-11 show the results of coefficient of restitution ("COR") tests performed on three separate racquets. Each of the three racquets have similar head and hoops shapes and sizes. All three racquets have a hoop or head size of approximately 99 square inches. The head or hoop shapes of the three racquets are conventional, traditional generally oval head shapes.

FIGS. 9-11 illustrate mappings of the areas of various COR values for a racquet of the present invention and for two representative prior art racquets. The COR is the ratio of the rebound velocity of a ball, such as, for example, a tennis ball, to the incoming velocity of the ball. The COR values of FIGS. 9-11 were measured by using an incoming velocity of 90 feet per second, +/−5 feet per second. Each mapping reflects the COR values resulting from the impacts of the ball with the string bed at numerous, distributed locations about the string bed. The racquet is supported in the test apparatus only at the handle. In particular, the test apparatus secures the proximal end of the handle (approximately the proximal 6 inches of the handle). The attachment of the test apparatus to the racquet restricts the proximal end of the handle from moving or twisting along the x, y or z axes. Each racquet of FIGS. 9-11 utilized a 16 gauge string, strung at a tension of 55 lbs tension. The racquets were measured in a strung condition generally at the center of the string bed.

FIG. 9 illustrates the areas of COR for a racquet having substantially the same frame as the racquet of FIG. 10, but the features of the present invention. The racquet of FIG. 9 is a racquet model, Babolat® Pure Drive™, produced by Babolat VS of Lyon, France, and serves as a representative prior art racquet. The racquet of FIG. 8 has a stringing pattern of 16×19. The numerical values of the COR areas for the racquet mapped in FIG. 9 are provided in Table 9. The maximum COR reading for the racquet of FIG. 9 was 0.40 with an area of 0.40 COR of 7.29 square inches.

FIG. 10 illustrates the areas of COR for another representative prior art racquet. The racquet is a Wilson® racquet, model Steam 99™ produced by Wilson Sporting Goods Co. of Chicago, Ill. The racquet has generally the same shape, head size, and weight as the racquet of FIG. 11 and similar shape, head size and weight as the racquet of FIG. 9. The racquet of FIG. 9 has a stringing pattern of 16×18. The numerical values of the COR areas for the racquet mapped in FIG. 94 are provided in Table 9. The maximum COR reading for the racquet of FIG. 10 was 0.40 with an area of 0.40 COR of 7.58 square inches.

FIG. 11 illustrates the enlarged areas of COR for a racquet built in accordance with a preferred embodiment of the present invention. The racquet of FIG. 11 a 16×15 stringing pattern and other features of the present invention. The numerical values of the COR areas for the racquet mapped in FIG. 11 are also provided in Table 9. The maximum COR reading for the racquet of FIG. 11 was 0.45 with an area of 0.40 COR of 9.903 square inches.

In FIGS. 9-11, the curved line labeled 0.40 represents the border of the area on the strings where the COR was 0.40 or greater. The curved line indicated as 0.35 represents the border of the area on the strings where the COR was 0.35 or greater. Similarly, the other curved lines in FIGS. 9-11 represent borders for the areas on the strings for various values of COR. In FIG. 11 alone, the curved line labeled 0.45 is illustrated indicating the border of the area on the strings where the COR was 0.45 or greater. The "sweet spot" of the racquet is generally defined as the area of the string bed having one of the three following COR values: 0.25 or greater, 0.30 or greater, or 0.35 or greater. The numbers on the horizontal and vertical axes of FIGS. 9-11 represent the distance from the center of the strung surface. For example, the center of the strung surface is indicated as 0.00. Two inches to the right of center of the strung surface is indicated as 2.00, 2 inches to the left of the center is indicated as −2.00, etc.

Table 9 below summarizes the COR data provided on FIGS. 9-11.

TABLE 9

COMPARISON OF COR AREAS FOR RACQUETS OF PRESENT INVENTION WITH TWO PRIOR ART RACQUETS

| COR | BABOLAT PURE DRIVE RACQUET OF FIG. 9 | WILSON STEAM WITH 16 × 18 STRINGING PATTERN OF FIG. 10 | WILSON STEAM WITH 16 × 15 STRINGING PATTERN OF FIG. 11 | % DIFFERENCE |
|---|---|---|---|---|
| 0.45 | 0.00 | 0.00 | 0.02 | None/Present |
| 0.40 | 7.29 | 7.58 | 9.903 | 36% & 31% |
| 0.30 | 23.04 | 24.02 | 27.93 | 21% & 16% |
| 0.25 | 32.25 | 33.18 | 38.19 | 18% & 15% |

A comparison of FIGS. 9-11 and the data of Table 9 indicates that the racquet made in accordance with the invention has a significantly greater "sweet spot" than either of the prior art racquets of FIGS. 9 and 10. The racquet of FIG. 11 of the present invention has greater area within most of the border lines for various CORs, and achieves a higher level of COR (0.45). In the 0.40 COR area, the improvement in the sweet spot area is dramatic with increases over 31%

The incorporation of the present invention significantly improves the racquet's performance by increasing the ability of a player to impart spin to a ball and by increasing the size of the sweet spot of the racquet. The present invention provides a racquet with an enlarged sweet spot, increased main string deflection, reduced snap back time, increased main string snap velocity, and an increased "dwell time" without increasing the polar moment of inertia of the racquet head and without negatively affecting the maneuverability of the racquet.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A tennis racquet configured for use with a string bed formed of a plurality of cross string segments interlaced with a plurality of main string segments, the racquet comprising:

a frame extending along a longitudinal axis and including a head portion coupled to a handle portion, the head portion including a hoop having inner and outer peripheral walls, the hoop defining a head size of the racquet, the head size being within the range of 93 square inches to 120 square inches, having a maximum longitudinal dimension, a, and having a maximum transverse dimension, b, the longitudinal dimension a being at least 1.2 times the transverse dimension b, the inner peripheral wall including a plurality of cross-string holes and a plurality of main string holes, each of the cross string holes configured for receiving one end of one of the cross string segments and each of the main string holes configured for receiving one end of one of the main string segments, the number of main string holes being greater than the number of cross string holes such that the string bed configured for use with the racquet has one, two or three fewer cross string segments than main string segments, the number of main string holes and the number of cross string holes being such that the plurality of main string segments of the string bed is within the range of 14 to 20 main string segments, and the plurality of cross string segments of the string bed is within the range of 11 to 19 cross string segments.

2. The racquet of claim 1, wherein the maximum longitudinal dimension a is at least 1.25 times the transverse dimension b.

3. The racquet of claim 1, wherein the inner peripheral wall defines at least four more main string holes than cross string holes, such that the string bed configured for use with the racquet has at least two more main string segments than cross string segments.

4. The racquet of claim 1, wherein the inner peripheral wall defines at least six more main string holes than cross string holes, such that the string bed configured for use with the racquet has three more main string segments than cross string segments.

5. The racquet of claim 1, wherein the pair of cross string holes closest to the handle portion of the racquet define a transverse line, c, wherein the ratio of the maximum longitudinal dimension a to the longitudinal distance from the bottom of the hoop to the transverse line, c, is at least 6.5.

6. The racquet of claim 5, wherein the ratio of the maximum longitudinal dimension, a, to the longitudinal distance from the bottom of the hoop to the transverse line, c, is at least 7.5.

7. The racquet of claim 1, wherein the frame is formed of a fiber composite material.

8. The racquet of claim 1, wherein the head size is within the range of 98 to 115 square inches.

9. A tennis racquet comprising:

a frame extending along a longitudinal axis and including a head portion coupled to a handle portion, the head portion including a hoop having inner and outer peripheral walls, the hoop defining a head size having a maximum longitudinal dimension, a, and having a maximum transverse dimension, b, the longitudinal dimension a being at least 1.2 times the transverse dimension b, the inner peripheral wall including a plurality of string holes; and a string bed coupled to the head portion of the racquet, the string bed including a plurality of cross string segments interlaced with a plurality of main string segments, each of the cross string segments transversely extending from one of the string holes to another one of the string holes, and each of the main string segments substantially longitudinally extending from one of the string holes to another one of the string holes, the pair of string holes that receive the cross string segment of the string bed closest to the handle portion defining a transversely extending line, the racquet including a second longitudinal dimension, c, defined by a first point positioned where the transverse line crosses the longitudinal axis and the end point of the maximum longitudinal dimension a closest to the handle portion, the ratio of the maximum longitudinal dimension a to the second longitudinal dimension c being at least 6.5, the string bed having one, two or three more main string segments than cross string segments, the plurality of main string segments of the string bed being within the range of 14 to 20 main string segments, and the plurality of cross string segments of the string bed being within the range of 11 to 19 cross string segments.

10. The racquet of claim 9, wherein the head size is within the range of 93 to 120 square inches.

11. The racquet of claim 9, wherein the head size is within the range of 98 square inches to 115 square inches.

12. The racquet of claim 9, wherein the maximum longitudinal dimension a is at least 1.25 times the transverse dimension b.

13. The racquet of claim 9, wherein the string bed includes at least two more main string segments than cross string segments.

14. The racquet of claim 9, wherein the string bed includes three more main string segments than cross string segments.

15. The racquet of claim 9, wherein the ratio of the maximum longitudinal dimension a to the second longitudinal dimension c is at least 7.5.

16. The racquet of claim 9, wherein the frame is formed of a fiber composite material.

17. The racquet of claim 9 wherein the frame further includes a throat portion positioned between the head and handle portions, wherein the head portion includes an upper region, and first and second side regions, and wherein the frame further includes a yoke coupled to, and extending between, the first and second side regions such that the upper region, the first and second side regions and the yoke define the hoop.

18. The racquet of claim 17 wherein the string bed does not extend beyond the yoke to the handle portion.

19. The racquet of claim 9, wherein the string bed is formed of polyester, monofilament racquet string.

20. The racquet of claim 9 wherein at least one of the string holes includes at least two string segments.

21. The racquet of claim 9, wherein each of the string holes includes only one of the cross string segments or one of the main string segments.

22. The racquet of claim 9, wherein each of the string holes includes at least one of the string segments.

* * * * *